US010830237B2

(12) United States Patent
Choi et al.

(10) Patent No.: US 10,830,237 B2
(45) Date of Patent: Nov. 10, 2020

(54) COMPRESSOR HAVING INTEGRATED FLOW PATH STRUCTURE

(71) Applicant: LG ELECTRONICS INC., Seoul (KR)

(72) Inventors: Yong Kyu Choi, Seoul (KR); Nara Han, Seoul (KR); Cheol Hwan Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 206 days.

(21) Appl. No.: 15/830,161

(22) Filed: Dec. 4, 2017

(65) Prior Publication Data

US 2018/0372103 A1 Dec. 27, 2018

(30) Foreign Application Priority Data

Jun. 21, 2017 (KR) ..... 10-2017-0078749

(51) Int. Cl.
*F01C 1/02* (2006.01)
*F03C 2/00* (2006.01)
(Continued)

(52) U.S. Cl.
CPC ..... *F04C 29/023* (2013.01); *F04C 18/0215* (2013.01); *F04C 27/005* (2013.01);
(Continued)

(58) Field of Classification Search
CPC ..... F04C 18/0215; F04C 18/0246; F04C 18/0261; F04C 18/0292; F04C 23/008;
(Continued)

(56) References Cited

U.S. PATENT DOCUMENTS 4,596,520 A 6/1986 Arata et al.
4,626,180 A 12/1986 Tagawa
(Continued)

FOREIGN PATENT DOCUMENTS

EP 1 526 283 4/2005
EP 2 369 182 9/2011
(Continued)

OTHER PUBLICATIONS

European Search Report dated May 4, 2018 issued in Application No. 17204354.9.
(Continued)

*Primary Examiner* — Theresa Trieu
(74) *Attorney, Agent, or Firm* — Ked & Associates LLP

(57) ABSTRACT

A compressor is provided having an integrated flow path structure in which an oil flow path and an intermediate pressure flow path are integrated into one in a compression unit, thereby simplifying a flow path of the compression unit. The compressor may include at least one integrated flow path in which the oil flow path and the refrigerant gas flow are integrated into one in a fixed scroll. The at least one integrated flow path may connect an intermediate pressure chamber and a compression chamber in a compressors unit. The at least one integrated flow path may provide a compressed refrigerant in the compression chamber to the intermediate pressure chamber and provide oil in the intermediate pressure chamber to the compression chamber, simplifying the flow path of the compression unit.

19 Claims, 12 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 29/02*** | (2006.01) |
| ***F04C 18/02*** | (2006.01) |
| ***F04C 27/00*** | (2006.01) |
| *F04C 23/00* | (2006.01) |

(52) U.S. Cl.
CPC ..... *F04C 23/008* (2013.01); *F04C 2210/26* (2013.01); *F04C 2240/30* (2013.01); *F04C 2240/60* (2013.01); *F04C 2240/603* (2013.01)

(58) Field of Classification Search
CPC .. F04C 27/005; F04C 29/023; F04C 2210/26; F04C 2240/30; F04C 2240/60; F04C 2240/603
USPC ..... 418/55.1–55.6, 57, 88, 94, 270
See application file for complete search history.

(56) References Cited

U.S. PATENT DOCUMENTS

| | | | | |
|---|---|---|---|---|
| 4,768,936 | A | 9/1988 | Etemad | |
| 4,898,521 | A | 2/1990 | Sakurai | |
| 5,803,722 | A | 9/1998 | Noboru | |
| 6,273,691 | B1 | 8/2001 | Morimoto et al. | |
| 2009/0098000 | A1 | 4/2009 | Ignatiev | |
| 2010/0122549 | A1 | 5/2010 | Cho | |
| 2012/0148434 | A1 | 6/2012 | Takabe et al. | |
| 2013/0078131 | A1* | 3/2013 | Ahn | F04C 18/0215 418/55.6 |
| 2013/0343941 | A1 | 12/2013 | Kim et al. | |
| 2014/0234148 | A1 | 8/2014 | Takeda | |
| 2016/0040671 | A1 | 2/2016 | Choi et al. | |
| 2016/0040673 | A1 | 2/2016 | Lee et al. | |
| 2016/0047378 | A1 | 2/2016 | Choi et al. | |
| 2016/0053759 | A1 | 2/2016 | Choi et al. | |
| 2016/0108917 | A1 | 4/2016 | Bonnefoi | |
| 2016/0341249 | A1 | 11/2016 | Yang | |

FOREIGN PATENT DOCUMENTS

| | | |
|---|---|---|
| EP | 2 574 791 | 4/2013 |
| EP | 2 690 287 | 1/2014 |
| JP | S 62-178791 | 8/1987 |
| JP | H 03-202682 | 9/1991 |
| JP | H 07-054784 | 2/1995 |
| JP | H 08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-1059880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

European Search Report dated May 17, 2018 issued in Application No. 17205582.4.
Korean Office Action dated Jul. 16, 2018 issued in Application No. 10-2017-0075041.
European Search Report dated Apr. 26, 2018 issued in Application No. 17199214.2.
Korean Office Action dated Aug. 20, 2018.
European Search Report dated Sep. 7, 2018.
U.S. Office Action dated Jan. 28, 2020 issued in co-pending related U.S. Appl. No. 15/830,222
United States Office Action dated Jan. 14, 2020 issued in co-pending related U.S. Appl. No. 15/830,135.
U.S. Office Action dated Nov. 14, 2019 issued in U.S. Appl. No. 15/830,290.
European Office Action dated Feb. 6, 2020.
U.S. Notice of Allowance issued in U.S. Appl. No. 15/830,222 dated Jun. 18, 2020.
U.S. Office Action dated Apr. 30, 2020 issued in U.S. Appl. No. 15/830,290.
U.S. Appl. No. 15/830,135, filed Dec. 4, 2017.
U.S. Appl. No. 16/692,112, filed Nov. 22, 2019.
U.S. Appl. No. 15/830,184, filed Dec. 4, 2017.
U.S. Appl. No. 15/830,222, filed Dec. 4, 2017.
U.S. Appl. No. 16/692,088, filed Nov. 22, 2019.
U.S. Appl. No. 15/830,248, filed Dec. 4, 2017.
U.S. Appl. No. 15/830,290, filed Dec. 4, 2017.

* cited by examiner

COMPRESSOR HAVING INTEGRATED FLOW PATH STRUCTURE

CROSS-REFERENCE TO RELATED APPLICATION(S)

This application claims priority to and the benefit of Korean Patent Application No. 10-2017-0078749, filed in Korea on Jun. 21, 2017, the disclosure of which is incorporated herein by reference in its entirety.

BACKGROUND

1. Field

A compressor is disclosed herein, the compressor having an integrated flow path structure in which an oil flow path and an intermediate pressure flow path are integrated into one in a compression unit, thereby simplifying the flow path of the compression unit.

2. Background

Generally, a compressor is applied to a vapor compression-type refrigeration cycle device, such as a refrigerator or an air conditioner, for example. Compressors can be classified into reciprocating, rotary, vane, and scroll compressors depending on a method of compressing a fluid, such as a refrigerant. Among these, the scroll compressor includes a fixed scroll fixed to an inner space of a seated container and a compression unit including an orbiting scroll that performs an orbiting motion while being engaged with the fixed scroll. In addition, the scroll compressor includes a drive motor that generates a drive force transmitted to the orbiting scroll.

A pair of compression chambers are formed between a fixed wrap of the fixed scroll and an orbiting wraps of the orbiting scroll. The scroll compressor compresses the fluid introduced into the compression chamber through the orbiting motion of the orbiting scroll. An Oldham's ring may be provided between the fixed scroll and the orbiting scroll. The Oldham's ring makes it possible to turn the orbiting scroll on the fixed scroll while preventing the orbiting scroll from rotating.

The scroll compressor can obtain a relatively high compression ratio in comparison with other types of compressors. The scroll compressor is advantageous in that section, compression, and discharge operations of a refrigerant are smoothly connected to each other to obtain a stable torque. Therefore, the scroll compressor is widely used for compressing the refrigerant in an air conditioner, for example.

The scroll compressor may be classified into an upper compression-type scroll compressor or a lower compression-type scroll compressor depending on positions of the compression unit and the drive motor. In the upper compression-type scroll compressor, the compression unit is positioned above the drive motor. In the lower compression-type scroll compressor, the compression unit is positioned below the drive motor.

In a case of the conventional scroll compressor, the fixed scroll may include an intermediate pressure flow path used as a refrigerant gas flow path and a first differential pressure oil supply flow path used as an oil flow path, and the orbiting scroll may include a second differential pressure oil supply flow path used as an oil flow path. However, in the conventional fixed scroll, the refrigerant gas flow path and the intermediate pressure flow path are formed separately, and thus, a processing time and manufacturing costs are increased due to the formation of a plurality of flow paths. Further, when the scroll compressor is operated, a plurality of flow paths is formed on the fixed scroll, and thus, an impact noise, for example, an impact noise of the Oldham's ring, due to friction is increased. Further, when the first differential pressure oil supply flow path is disposed adjacent to the second differential pressure oil supply flow path, oil discharged from the first differential pressure oil supply flow path flows directly to the second differential pressure oil supply flow path, so that the oil is not uniformly diffused into an intermediate pressure chamber.

BRIEF DESCRIPTION OF THE DRAWINGS

Embodiments will be described in detail with reference to the following drawings in which like reference numerals refer to like elements, and wherein.

DETAILED DESCRIPTION

Figure 1:
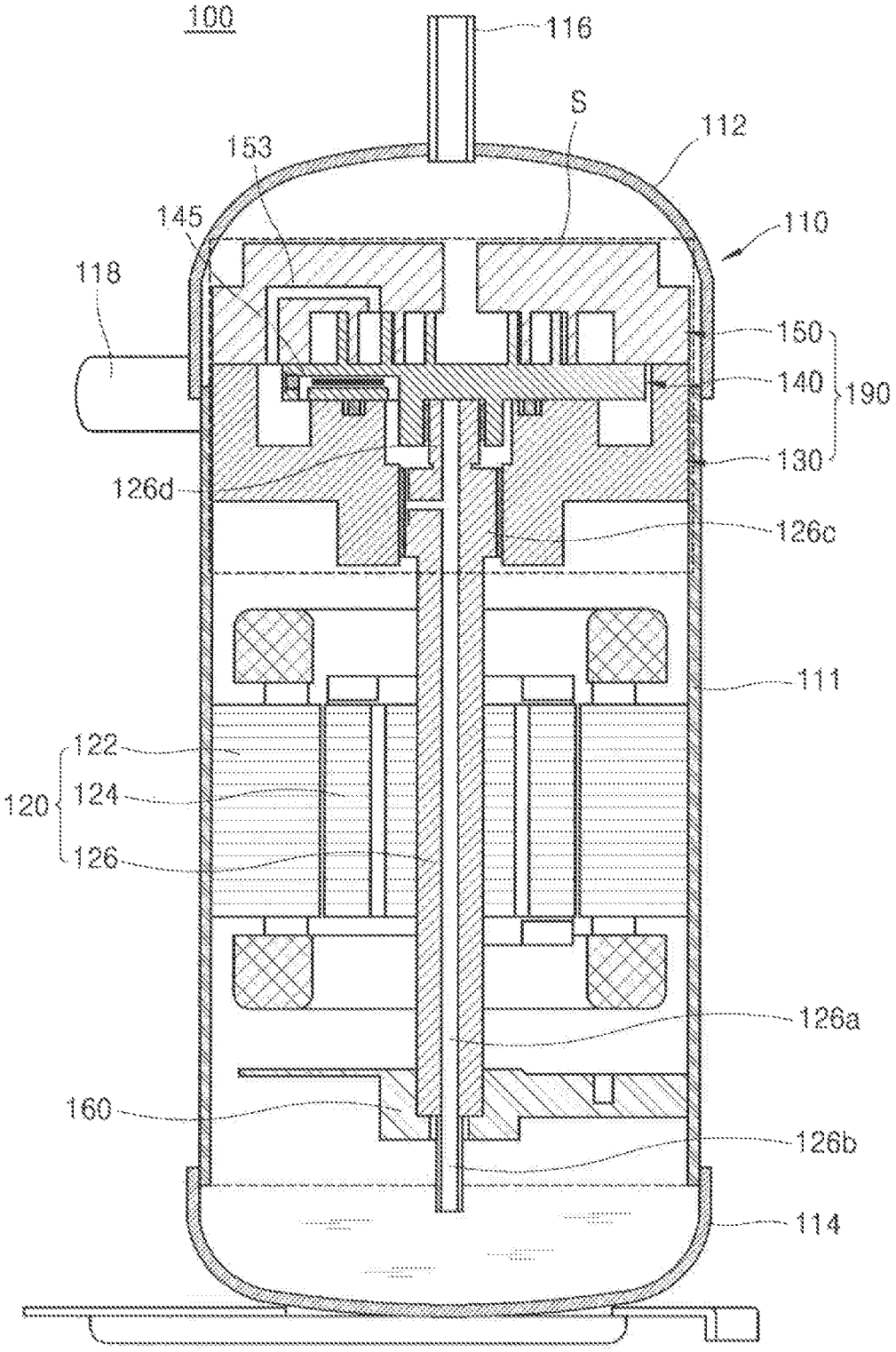
FIG. 1 is a cross-sectional view of a compressor according to an embodiment.

Hereinafter, embodiments will be described with reference to the accompanying drawings. In the drawings, the same or like reference numerals are used to denote the same or like elements, and repetitive disclosure has been omitted.

Hereinafter, a compressor according to embodiments will be described with reference to FIGS. 1 to 11.

A compressor 100 according to an embodiment described with reference to FIGS. 1 to 8 may have an upper compression structure in which a compression unit 190 including an orbiting scroll 140 and a fixed scroll 150 is positioned above a drive motor 120. In addition, the compressor 100 has a structure (hereinafter, referred to as an "axis non-through structure") in which a rotary shaft 126 does not pass through the compression unit 190. On the other hand, a compressor 200 according to another embodiment described with reference to FIGS. 7 to 11 has a lower compression structure in which a compression unit 290 including an orbiting scroll 240 and a fixed scroll 250 is positioned below a drive motor 220. In addition, the compressor 200 has an axis-through structure in which a rotary shaft 226 passes through the compression unit 290.

However, emblements are not limited thereto, and although not shown in the drawings, an integrated flow path structure included in a compressor according to an embodiment, which will be described hereinafter may be used for the upper compression structure including the axis-through structure. Similarly, the integrated flow path structure may be used for the lower compression structure including the axis non-through structure. In addition, the integrated flow path structure may be applied to a compressor whose compression unit is disposed in a transverse direction of a drive motor.

FIG. 1 is a cross-sectional view of a compressor according to an embodiment. Referring to FIG. 1, the compressor 100 according to an embodiment may include a casing 110 having an inner space, the drive motor 120 disposed at a lower or central portion of the inner space, the compression unit 190 disposed at an upper portion of the drive motor 120, and the rotary shaft 120 that transmits the drive force of the drive motor 120 to the compression unit 190.

The casing 110 may include a cylindrical shell 111, an upper shell 112 provided on or at an upper portion of the cylindrical shell 111, and a lower shell 114 provided below the cylindrical shell 111. For example, the casing 110 may have a cylindrical shape. However, embodiments are not limited thereto, and the casing 110 may be formed in various shapes. The upper and lower shells 112 and 114 may be, for example, welded to the cylindrical shell 111 to form the inner space.

A discharge pipe 116 may be formed on or at an upper portion of the upper shell 112. The discharge pipe 116 may be a passage through which a compressed refrigerant may be discharged to the outside. An oil separator (not shown) that separates oil mixed with the discharged refrigerant therefrom may be connected to one side of the discharge pipe 116.

A suction pipe 118 may be disposed or provided on or at a side surface of the cylindrical shell 111. The suction pipe 118 may be a passage through which a refrigerant to be compressed may be introduced. In FIG. 1, the suction pipe 118 is located at a boundary between the cylindrical shell 111 and the upper shell 112; however, embodiments are not limited thereto, and a position thereof may be arbitrarily set. In addition, the lower shell 114 may function as an oil storage space to store oil so that the compressor may be smoothly operated.

The drive motor 120 which operates as a drive unit and the compression unit 190 which compresses the refrigerant may be provided inside of the casing 110. The drive motor 120 may include a stator 122, which may be fixed to an inner surface of the casing 110, and a rotor 124, which may be positioned inside of the stator 122 and rotated by interaction with the stator 122. The rotary shaft 126 may be fixed to a center of the rotor 124 so that the rotor 124 and the rotary shaft 126 may rotate together.

An oil flow path 126*a* may be formed at an inside of the rotary shaft 126 so as to extend along a longitudinal direction of the rotary shaft 128. An oil pump 126*b* to supply the oil stored in the lower shell 114 upward may be provided at a lower end of the rotary shaft 126. Although not shown in the drawings, the oil pump 126*b* may be provided with a helical groove formed in the oil flow path, or a trochoid pump (not shown) to forcibly pump the oil stored in the oil storage space upward may be connected to the oil pump 126*b*.

The compression unit 190 may include a main frame 130, the fixed scroll 150, and the orbiting scroll 140. The main frame 130 and a sub frame 160 that support the rotary shaft 126 of the drive motor 120 may be fixedly provided on or at upper and lower sides of the casing 110, respectively. The main frame 130 may support one or a first side or end of the rotary shaft 126 in a radial direction, and the sub frame 160 may support the other or a second side or end of the rotary shaft 126 in the radial direction.

The fixed scroll 150 may be fixedly provided on or at an upper surface of the main frame 130. The orbiting scroll 140 which performs an orbiting motion while being engaged with the fixed scroll 150 may be provided between the main frame 130 and the fixed scroll 150. The orbiting scroll 140 may include an orbiting wrap 141 that engage with a fixed wrap 151 of the fixed scroll 150 to form a plurality of compression chambers P.

Detailed descriptions of the fixed scroll 150 and the orbiting scroll 140 are provided hereinafter with reference to FIGS. 2-3. An Oldham's ring 131 that turns the orbiting scroll 140 while preventing the orbiting scroll 140 from rotating may be provided between the orbiting scroll 140 and the main frame 130.

Hereinafter, an integrated flow path structure included in the compression unit 190 will be described with reference to FIGS. 2-3.

Figure 2:
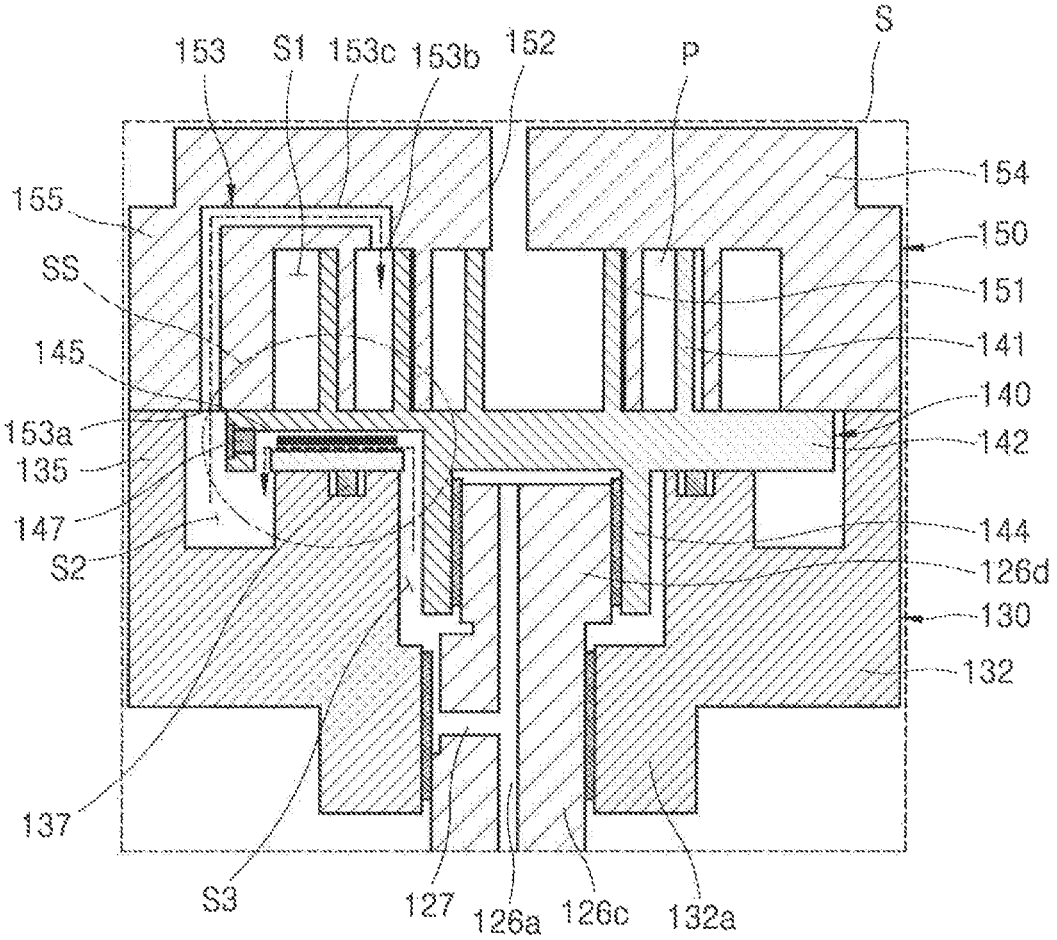
FIG. 2 is a partial cross-sectional view of an integrated flow path structure of the compression unit of the compressor of FIG. 1 according to an embodiment.

FIG. 2 is a partial cross-sectional view of an integrated flow pain structure of the compression unit of the compressor of FIG. 1, that is, FIG. 2 is a partial enlarged cross-sectional view showing an area S of FIG. 1. FIG. 3 is a partial enlarged cross-sectional view showing an area SS of FIG. 3.

Figure 3:
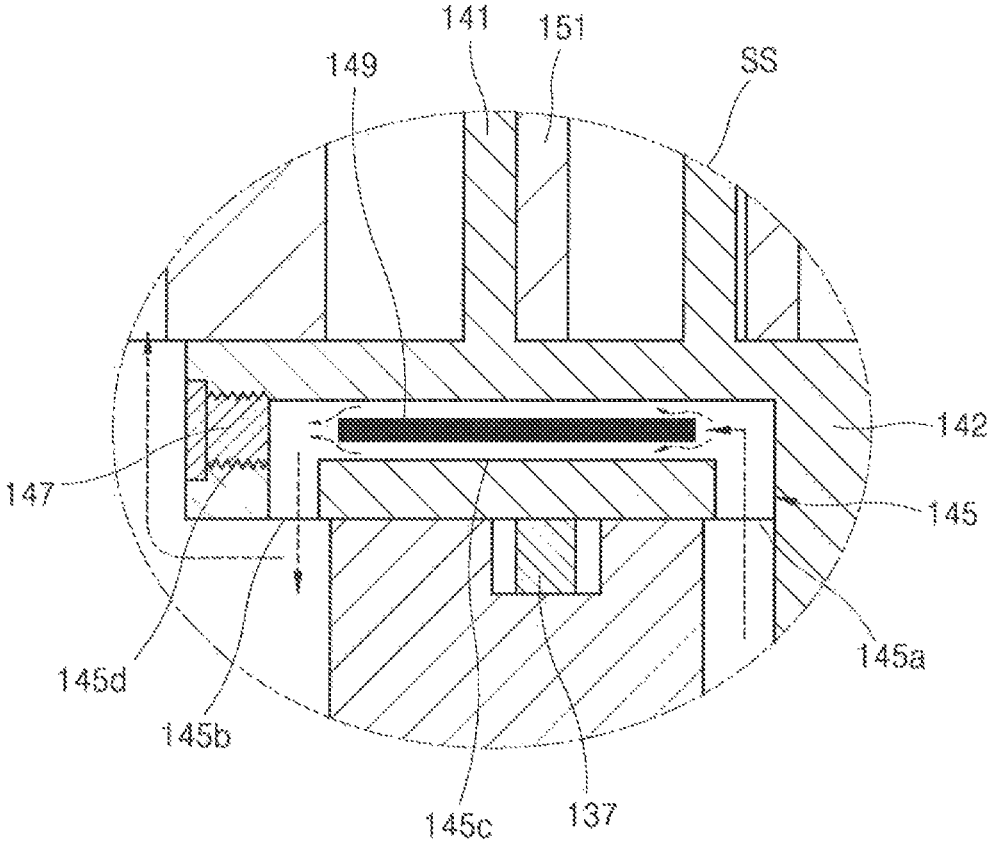
FIG. 3 is a partial enlarged view showing an area SS of FIG. 2.
Figure 4:
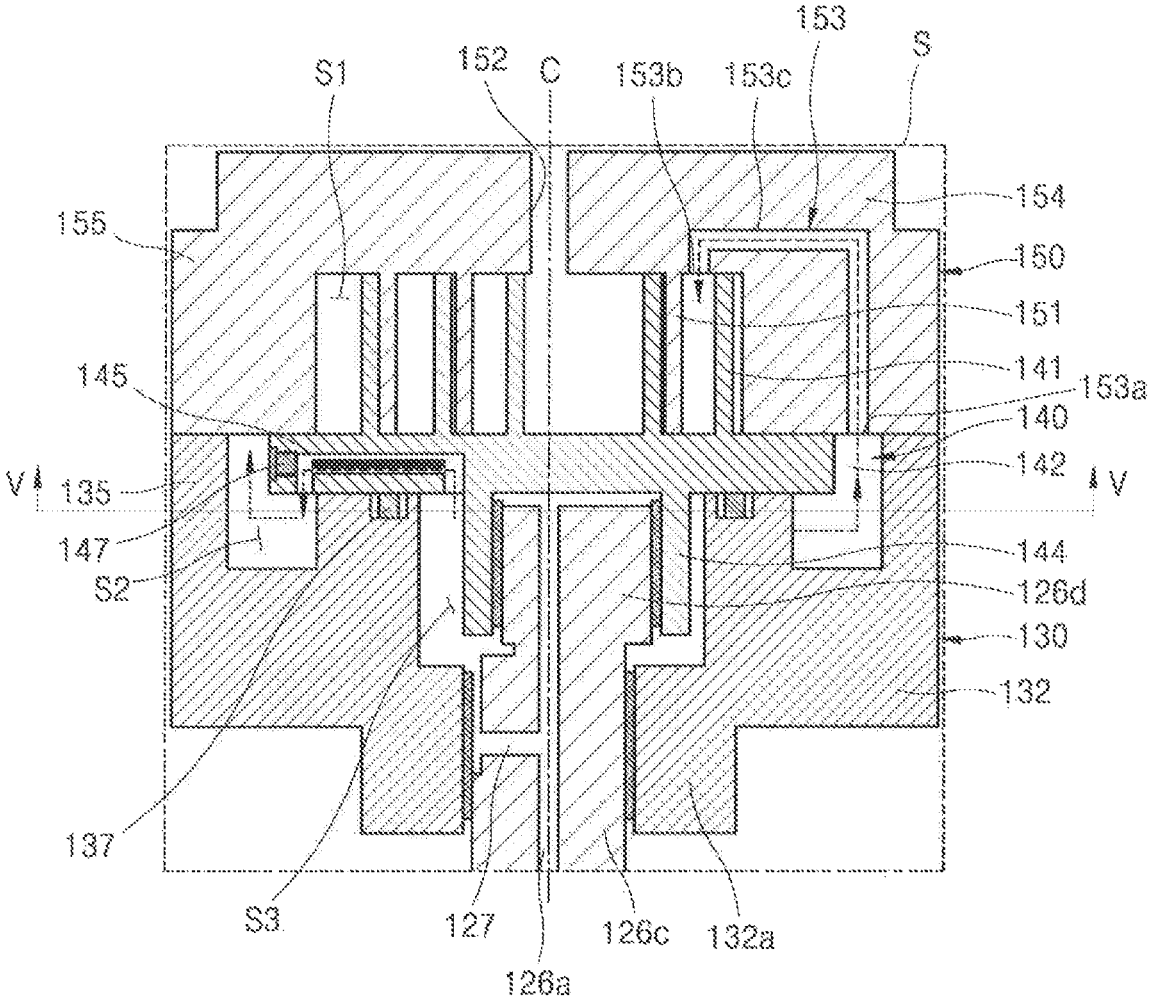
FIG. 4 is a partial cross-sectional view of an integrated flow path structure of the compression unit of the compressor of FIG. 1 according to another embodiment.

Referring to FIGS. 3-4, the compression unit 190 of the compressor 100 according to an embodiment may include the main frame 130, the orbiting scroll 140, and the fixed scroll 150. The main frame 130 may be provided in or at an upper portion of the drive motor 120 and form a lower portion of the compression unit 190.

The main frame 130 may include with a circular frame end plate 132 (hereinafter, referred to as a "first end plate"), a frame shaft-receiving portion 132*a* (hereinafter, referred to as a "first shaft-receiving portion") provided at a center of the first end plate 132 and through which the rotary shaft 126 may pass, and a frame side wall 135 (hereinafter, referred to as a "first side wall") that protrudes upward from an outer circumferential portion of the first end plate 132. An outer peripheral portion of the first side wall 135 may be brought into contact with an inner circumferential surface of the casing 110 and an upper end of the first side wall 135 may be brought into contact with a lower end portion of a fixed scroll side wall 155.

The first shaft-receiving portion 132*a* may protrude from a lower surface of the first end plate 132 toward the drive motor 120 side. In addition, a first bearing portion may be formed in the first shaft-receiving portion 132*a* such that a main bearing portion 126*c* of the rotary shaft 126 may pass through the first bearing portion and be supported.

An intermediate pressure chamber S2 which forms a space together with the fixed scroll 150 and the orbiting scroll 140 to support the orbiting scroll 140 by a pressure of the space may be formed on an inner surface of the main frame 130. That is, the intermediate pressure chamber S2 may be formed by the main frame 130, the fixed scroll 150, and the orbiting scroll 140.

More specifically, the intermediate pressure chamber S2 may be defined as a space among the orbiting scroll 140, the fixed scroll 150, and the main frame 130. The intermediate pressure chamber S2 may be formed in a donut shape along an inner circumferential surface of the main frame 130.

An oil introduction chamber S3 may be defined as a space among the rotary shaft 126, the main frame 130, and the orbiting scroll 140. The oil introduction chamber S3 may be a space through which the oil suctioned along the oil supply flow path 126*a* inside of the rotary shaft 126 may be discharged.

A high pressure region may be formed in the oil supply flow path 126*a* and the oil introduction chamber S3, and an intermediate pressure region having a lower pressure than a pressure of the oil introduction chamber S3 may be formed in the intermediate pressure chamber S2. A portion of the oil discharged into the oil introduction chamber S3 may move to the intermediate pressure chamber S2 along a differential pressure oil supply flow path 145 of the orbiting scroll 140. In addition, another portion of the oil introduced into the oil introduction chamber S3 may be supplied to outer peripheral surfaces of the main bearing portion 126*c* and an eccentric portion 126*d*, or supplied between the orbiting scroll 140 and the fixed scroll 150.

A back pressure seal 137 may be provided between the oil introduction chamber S3 of the high pressure region and the intermediate pressure chamber S2 of the intermediate pressure region. The back pressure seal 137 may be located between the main frame 130 and the orbiting scroll 140, and formed by a sealing member or seal, for example, an elastic member. The main frame 130 may be coupled with the fixed scroll 150 to form a space in which the orbiting scroll 140 may be installed or provided.

The fixed scroll 150 may include a circular fixed end plate 154 (hereinafter, referred to as a "second end plate"), the fixed scroll side wall 155 (hereinafter, referred to as a "second side wall") that protrudes downward from an outer peripheral portion of the second end plate 154, and the fixed wrap 151 that protrudes from a lower surface of the second end plate 154 and engaged with the orbiting wrap 141 of the orbiting scroll 140 to form a compression chamber S1. An outer peripheral portion of the second side wall 155 may be brought into contact with an inner circumferential surface of the casing 110 or the upper shell 112, and a lower end portion of the second side wall 155 may be brought into contact with an upper surface of the first side wall 135.

A discharge port 152 may be formed at an upper center of the second end plate 154 so that a discharge side of the compression chamber S1 and a discharge space of the casing 110 may be connected to each other. In addition, an integrated flow path 153 may be formed in the second end plate 154.

The integrated flow path 153 may connect the intermediate pressure chamber S2 and the compression chamber S1. That is, one or a first end of the integrated flow path 153 may be connected to the intermediate pressure chamber S2 and the other or a second end thereof may be connected to the compression chamber S1. The compression chamber S1 may be defined as a space between the orbiting wrap 141 of the orbiting scroll 140 and the fixed wrap 151 of the fixed scroll 150 and may be a space for compressing and then discharging the refrigerant introduced from the outside.

The integrated flow path 153 may connect the intermediate pressure chamber S2 and the compression chamber S1 to form the intermediate pressure region in the intermediate pressure chamber S2 and to supply oil fed to the intermediate pressure chamber S2 to the compression chamber S1. The oil discharged into the intermediate pressure chamber S2 may be supplied to the compression chamber S1 via the integrated flow path 153. More specifically, the oil contained in the oil storage space may be supplied to the compression chamber S1 via a differential pressure oil supply flow path 145 to be described hereinafter and the integrated flew path 153.

Accordingly, the oil may be smoothly supplied to the compression chamber S1, and thus, wear due to friction between the orbiting scroll 140 and the fixed scroll 150 may be reduced, thereby improving compression efficiency. In addition, the oil supplied to the compression chamber S1 may form an oil film between the fixed scroll 150 and the orbiting scroll 140 to maintain an airtight state of the compression chamber S1.

Further, the oil supplied to the compression chamber S1 may absorb frictional heat generated during the occurrence of friction between the fixed scroll 150 and the orbiting scroll 140 to lower a temperature of the compression unit 190. In addition, the integrated flow path 153 may move a refrigerant gas compressed at a high pressure in the compression chamber S1 to the intermediate pressure chamber S2, and form an intermediate pressure corresponding to an average of a suction pressure and a discharge pressure in the intermediate pressure chamber S2.

The pressure formed in the intermediate pressure chamber S2 may act as a back pressure that presses a surface of the orbiting scroll 140. The back pressure that presses the surface of the orbiting scroll 140 may be in equilibrium with an expansion pressure formed in the compression chamber S1. The back pressure may prevent the orbiting scroll 140 from tilting during the orbiting operation of the orbiting scroll 140 and generating noise or prevent the compression efficiency from being reduced.

The integrated flow path 153 may pass through the second side wall 155 and the second end plate 154. More specifically, the integrated flow path 153 may include a third hold 153*a*, a fourth hole 153*b*, and a horizontal flow path 153*c*.

The third hole 153*a* may be formed on a surface of the second side wall 155 and connected to the intermediate pressure chamber S2. The third hole 153*a* may be formed of a plurality of holes; however, embodiments are not limited thereto.

The fourth hole 153*b* may be formed on a surface of the second end plate 154 and connected to the compression chamber S1. Similarly, the fourth hole 153*b* may be formed of a plurality of holes; however, embodiments are not limited thereto.

The horizontal flow path 153*c* may be formed inside of the second end plate 154 so as to connect the third hole 153*a* and the fourth hole 153*b* and may extend parallel to a surface of the second end plate 154.

The integrated flow path 153 may pass through only the second side wall 155. In this case, a length of the integrated flow path 153 may be decreased in comparison with a case in which the integrated flow path 153 passes through both the second side wall 155 and the second end plate 154. The integrated flow path 153 may be formed in a "¬" or "⊏" shape in the second end plate 154 of the fixed scroll 150; however, embodiments are not limited thereto.

Additionally, although not shown in the drawings, a plurality of integrated flow paths 153 may be formed in the fixed scroll 250. The plurality of integrated flow paths 153 may be provided in the fixed scroll 250 at regular intervals. A number of the integrated flow paths 153 may be the same as a number of the differential pressure oil supply flow path 145, which is described hereinafter. However, embodiments are not limited thereto.

The orbiting scroll 140 coupled to the rotary shaft 126 to perform the orbiting motion may be installed or provided between the main frame 130 and the fixed scroll 150. The orbiting scroll 140 may include a circular orbiting end plate 142 (hereinafter, referred to as a "third end plate portion"), the orbiting wrap 141 that protrudes from an upper surface of the third end plate 142 and is engaged with the fixed wrap 151, and a rotary shaft coupler 144 provided on a lower surface of the third end plate 142 and rotatably coupled to the eccentric portion 120*d* of the rotary shaft 126. In a case of the orbiting scroll 140, the lower surface of the third end plate 142 may be in close contact with an upper surface of the first end plate 132 and supported by the main frame 130.

The orbiting wrap 141 may form the compression chamber S1 together with the fixed wrap 151 during a compression process. The fixed wrap 151 and the orbiting wrap 141 may be formed in an involute shape. The involute shape means a curved line corresponding to a locus drawn by an end portion of a thread when the thread wound around a base circle having an arbitrary radius is released. However, shapes of the fixed wrap 151 and the orbiting wrap 141 are not limited thereto.

A second bearing portion may be provided in the rotary shaft coupler 144 so that the eccentric portion 126*d* of the rotary shaft 126 may be inserted into the second bearing portion and supported. In addition, the orbiting scroll 140 may include the differential pressure oil supply flow path 145 formed in the third end plate 142. The differential pressure oil supply flow path 145 may connect the oil introduction chamber S3 and the intermediate pressure chamber S2.

More specifically, referring to FIG. 3, the differential pressure oil supply flow path 145 may include a first hole 145*a*, a second hole 145*b*, and a horizontal flow path 145*c*. The first hole 145*a* may be formed on the lower surface of the third end plate portion 142 and disposed close to a center of the orbiting scroll 140 to be connected to the oil introduction chamber S3. The first hole 145*a* may be formed of a plurality of holes; however embodiments are not limited thereto.

The second hole 145*b* may be formed on the lower surface of the third end plate 142 and disposed close to an outer circumferential surface of the orbiting scroll 140 to be connected to the intermediate pressure chamber S2. Similarly, the second hole 145*b* may be formed of a plurality of holes; however, embodiments are not limited thereto.

The horizontal flow path 145*c* may be formed inside of the third end plate 142 so as to connect the first hole 145*a* and the second hole 145*b* and extend parallel to an upper surface of the third end plate 142. Additionally, an opening 145*d* for opening a portion of a side surface of the third end plate 142 may be formed at one side of the first horizontal flow path 145*c*. An inner surface of the opening 145*d* may include a screw groove which may be fastened with a coupling bolt 147. However, embodiments are not limited thereto, and the inner surface of the opening 145*d* may be formed in various shapes which may be fastened to the coupling bolt 147, such as a stepped shape or a curved shape, for example.

The opening 145*d* may be used to insert a decompression pin 149 into the first horizontal flow path 145*c*. The inserted decompression pin 149 may be disposed or provided inside of the differential pressure oil supply flow path 145. A diameter of the decompression pin 149 may be smaller than a diameter of the first horizontal flow path 145*c*. The decompression pin 149 may adjust a pressure and a supply amount of oil in the differential pressure oil supply flow path 145 by forming a narrow flow path through which oil may move in the differential pressure oil supply flow path 145.

Although not shown in the drawings, other shaped-decompression members for forming a narrow flow path in the differential pressure oil supply flow path 145 may be used instead of the decompression pin 149. For example, a ball-shaped or polyhedral decompression filler may be used; however, embodiments are not limited thereto.

However, for convenience of description, in this embodiment, an example in which the decompression pin 149 is provided in the differential pressure oil supply flow path 145 will be described.

After the decompression pin 149 is inserted into the first horizontal flow path 145*c*, the coupling boil 147 may be fastened to the opening 145*d*. The coupling bolt 147 may be formed in a shape which may be coupled to the opening 145*d*.

For example, the coupling bolt 147 may be formed in a threaded, stepped, or curved shape corresponding to an inner shape of the opening 145*d*. However, embodiments are not limited thereto.

The coupling bolt 147 may be coupled to the opening 145*d* so that the "[illegible]" shaped differential pressure oil supply flow path 145 connecting the oil introduction chamber S3 and the intermediate pressure chamber S2 may be termed in the orbiting scroll 140. However, embodiments are not limited thereto, and the shape of the differential pressure oil supply flow path 145 may be diversely formed, such as in an S-shape or a "[illegible]" shape, for example.

The oil which has passed through the differential pressure oil supply flow path 145 to be discharged into the intermediate pressure chamber S2 may be supplied to a thrust surface between the orbiting scroll 140 and the fixed scroll 150. The oil discharged into the intermediate pressure chamber S2 may be supplied between the respective components of the compression unit 190 to reduce the friction of the compression unit 190.

Additionally, although not shown in the drawings, a plurality of differential pressure oil supply flow paths 145 may be formed in the scroll 140. In addition, the plurality of differential pressure oil supply flow paths 145 may be disposed or provided in the orbiting scroll 140 at regular intervals. A number of the differential pressure oil supply flow paths 145 may be formed to be the same as the number of the integrated flow paths 153. In addition, the plurality of differential pressure oil supply flow paths 145 may be formed so as to correspond one-to-one to the plurality of integrated flow paths 153. However, embodiments are not limited thereto.

The oil guided upward via the oil supply flow path 126*a* may be discharged through an oil hole 127 and supplied to outer peripheral surfaces of the main bearing portion 126*c* and the eccentric portion 126*d*. More specifically, the oil hole 127 may pass from the oil supply flow path 126*a* to an outer peripheral surface of the main bearing portion 126*c*.

In addition, the oil hole 127 may pass through, for example, an upper portion of the outer peripheral surface of the main bearing portion 128*c*. However, embodiments are not limited thereto, and the oil hole 127 may pass through a lower portion of the outer peripheral surface of the main bearing portion 126*c*.

The oil hole 127 may include a plurality of holes, unlike that shown in the drawings. When the oil hole 127 includes a plurality of holes, each of the holes may be formed only in the upper or lower portion of the outer peripheral surface of the main bearing portion 126*c*, or formed in the upper and lower portions of the outer peripheral surface of the main bearing portion 126*c*, respectively. However, for convenience of description, in this embodiment, the oil hole 127 includes one hole.

Next, a first portion of the high pressure oil discharged through the oil hole 127 may move to the oil introduction chamber S3 formed between the main frame 130 and the orbiting scroll 140. A second portion of the oil supplied to the oil introduction chamber S3 may be supplied to the outer peripheral surfaces of the main bearing portion 126*c* and the eccentric portion 126*d*.

The first portion of the oil supplied to the oil introduction chamber S3 may be supplied to the intermediate pressure chamber S2 through the differential pressure oil supply flow path 146 of the orbiting scroll 240 described above. The oil guided to the intermediate pressure chamber S2 through the differential pressure oil supply flow path 145 may be supplied to the thrust surface between the orbiting scroll 140 and the fixed scroll 150. As a result, wear of the thrust surface of the fixed scroll 150 may be reduced.

In addition, the oil guided to the intermediate pressure chamber S2 may be guided to the integrated flow path 153 provided in the fixed scroll 150. The integrated flow path 153 may connect the intermediate pressure chamber S2 and the compression chamber S1 to supply oil fed to the intermediate pressure chamber S2 to the compression chamber S1 and form an intermediate pressure corresponding to an average of a suction pressure and a discharge pressure in the intermediate pressure chamber S2.

That is, the integrated flow path 153 may be used as an oil flow path for providing oil and an intermediate pressure flow path for forming an intermediate pressure. Thus, according to embodiments, the oil flow path and the refrigerant gas flow path of the fixed scroll 150 may be integrated into one, thereby simplifying the flow path of the compression unit 190.

Accordingly, the number of flow paths required for the fixed scroll 150 used in the compressor 100 according to embodiments may be reduced in comparison to prior art. Thus, a manufacturing process for producing the fixed scroll 150 may be simplified, and a manufacturing time of the fixed scroll 150 may be reduced. Further, as the manufacturing process and time are reduced, manufacturing costs of the compressor 100 may be reduced.

Further, vibration and noise due to friction generated when a plurality of flow paths are formed in the fixed scroll 150 may be reduced by reducing the number of flow paths generated in the fixed scroll 150. Furthermore, by reducing vibration and noise generated during operation of the compressor 100, operational stability of the compressor 100 may be increased, and a user's satisfaction may also be enhanced.

Hereinafter, an integrated flow path structure of the compression unit of the compressor of FIG. 1 according to another embodiment will be described with reference to FIGS. 5 to 7.

FIG. 4 is a partial cross-sectional view of an integrated flow path structure of the compression unit of the compressor of FIG. 1 according to another embodiment. FIGS. 5 and 6 are cross-sectional views, taken along line V-V of FIG. 4.

Figure 5:
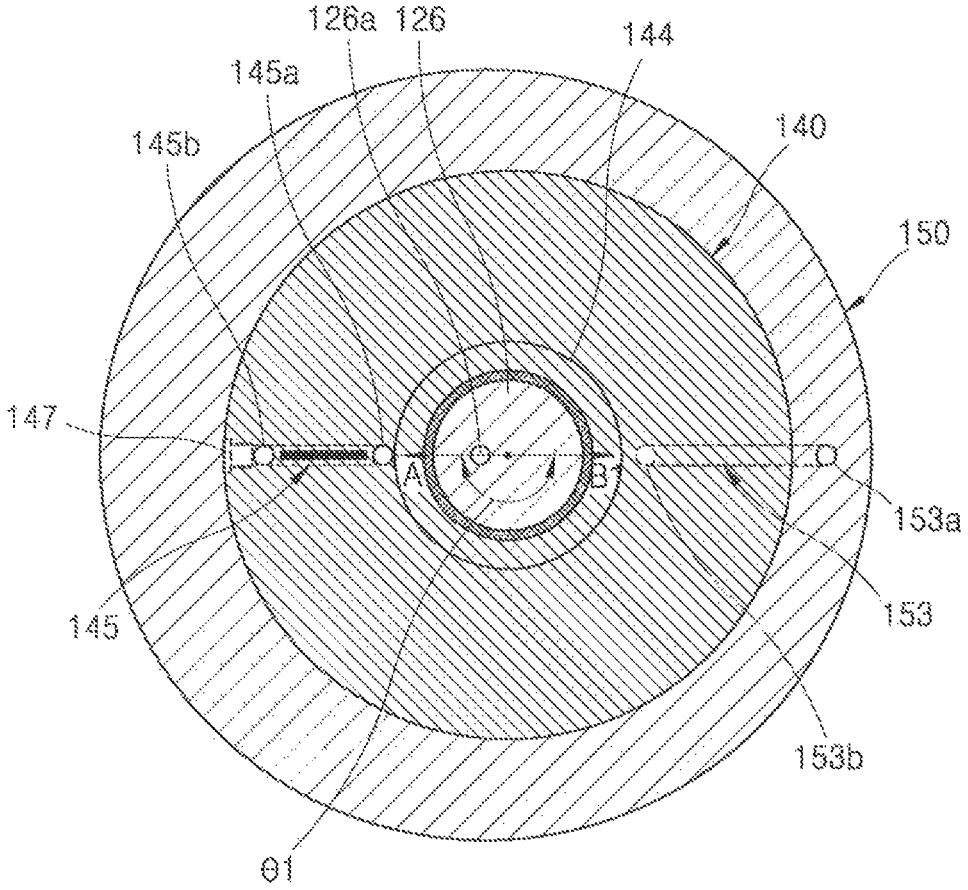
FIGS. 5 and 6 are cross-sectional views, taken along a line V-V of FIG. 4.
Figure 6:
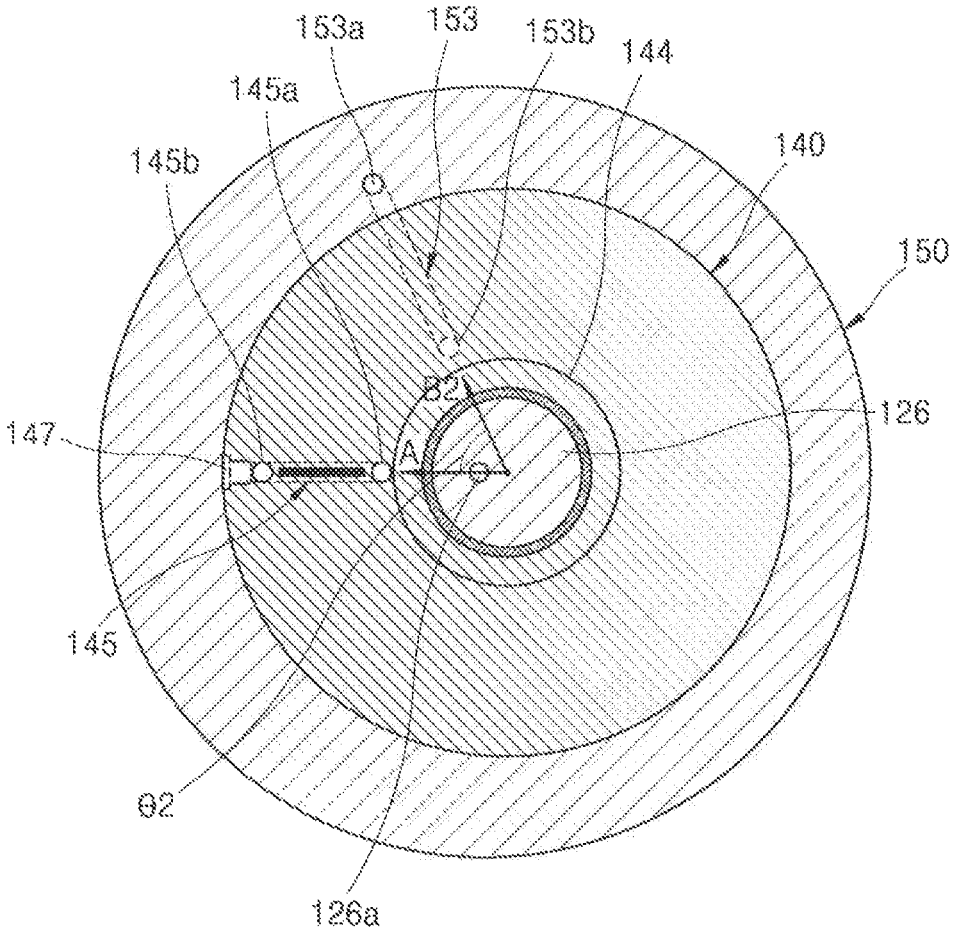

FIGS. 5 and 6 are plan views for explaining a positional relationship between the differential pressure oil supply flow path 145 and the integrated flow path 153. For convenience of description, repeated description of the same components as those of the previous embodiment will be omitted and description will be made focusing on differences therebetween.

Referring to FIG. 4, in the compressor 100, the differential pressure oil supply flow path 145 formed in the orbiting scroll 140 may be disposed or provided on of at one or a first side of the orbiting scroll 140 with respect to the rotary shaft 126, and disposed or provided on or at the other or a second side thereof with respect to the rotary shaft 126 of the integrated flow path 153 formed in the fixed scroll 150. For example, the differential pressure oil supply flow path 145 formed in the orbiting scroll 140 may be positioned on a first side (left side in the drawings) with respect to the rotary shaft 126, and the integrated flow path 153 formed in the fixed scroll 150 may be positioned on a second side (right side in the drawings) with respect to the rotary shaft 126. That is, the differential pressure oil supply flow path 146 and the integrated flow path 153 may be positioned opposite to each other with respect to a center C of the rotary shaft 126.

A first direction of the differential pressure oil supply flow path 145 extending outward from the inside of the orbiting scroll 140 may be formed to be different from a second direction of the integrated flow path 153 extending outward from the inside of the fixed scroll 150. More specifically, referring to FIG. 5, an angle θ1 between the first direction A of the differential pressure oil supply flow path 145 extending outward from the inside of the orbiting scroll 140 and the second direction B1 of the integrated flow path 153 extending outward from the inside of the fixed scroll 150 may be an obtuse angle. That is, the angle θ1 between the first direction A and the second direction B1 may be a value in a range of about 90 to 180 degrees.

In addition, referring to FIG. 6, an angle θ2 between the first direction A of the differential pressure oil supply flow path 145 extending outward from the inside of the orbiting scroll 140 and a third direction B2 of the integrated flow path 153 extending outward from the inside of the fixed scroll 150 may be an acute angle. That is, the angle θ2 between the first direction A and the third direction B2 may be a value in a range of about 0 to 90 degrees.

In this case, a distance between the second hole 145*b* through which the oil is discharged from the differential pressure oil supply flow path 145 and the third hole 153*a* through which the oil is introduced into the integrated flow path 153 may be formed to be larger than that in the embodiment described with reference to FIGS. 1 to 3. Accordingly, the oil discharged from the oil introduction chamber S3 to the intermediate pressure chamber S2 through the differential pressure oil supply flow path 145 may move along an inner peripheral surface of the intermediate pressure chamber S2. The oil discharged into the intermediate pressure chamber S2 may be uniformly diffused on the thrust surface between the orbiting scroll 140 and the fixed scroll 150 and uniformly diffused between the orbiting scroll 140 and the main frame 130, while moving toward the integrated flow path 153 along the inner peripheral surface of the intermediate pressure chamber S2.

Next, the oil guided to the integrated flow path 153 may be supplied to the compression chamber S1. The oil may be uniformly supplied to the intermediate pressure chamber S2 and the compression chamber S1 so that wear due to friction between the orbiting scroll 140 and the fixed scroll 150 and between the orbiting scroll 140 and the main frame 130 may be reduced. As a result, the compression efficiency of the compressor 100 may be improved.

In addition, the oil supplied to the intermediate pressure chamber S2 and the compression chamber S1 may form an oil film between the fixed scroll 150 and the orbiting scroll 140 to maintain an airtight state of the compression chamber S1. Further, the oil supplied to the intermediate pressure chamber S2 and the compression chamber S1 may absorb frictional heat generated during the occurrence of friction between the fixed scroll 150 and the orbiting scroll 140 to dissipate heat.

Additionally, as described above, as the number of flow paths required to be generated in the fixed scroll 150 is reduced, the manufacturing process and time may be reduced and the manufacturing costs may be reduced. In addition, vibration and noise due to friction generated when a plurality of flow paths is formed in the fixed scroll 150 may be reduced by reducing the number of flow paths generated in the fixed scroll 150.

Figure 7:
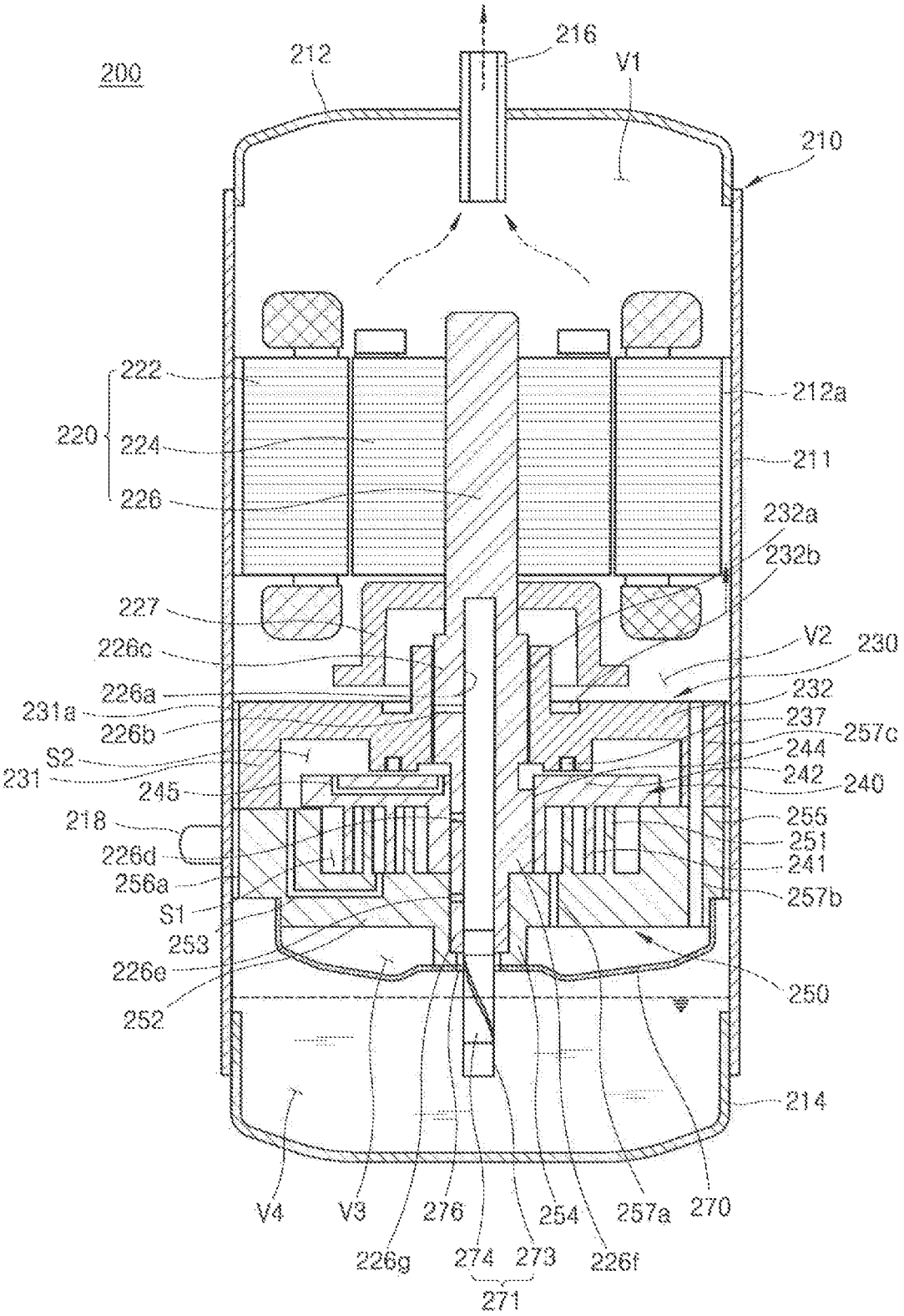
FIG. 7 is a cross-sectional view of a compressor according to another embodiment.
Figure 8A:
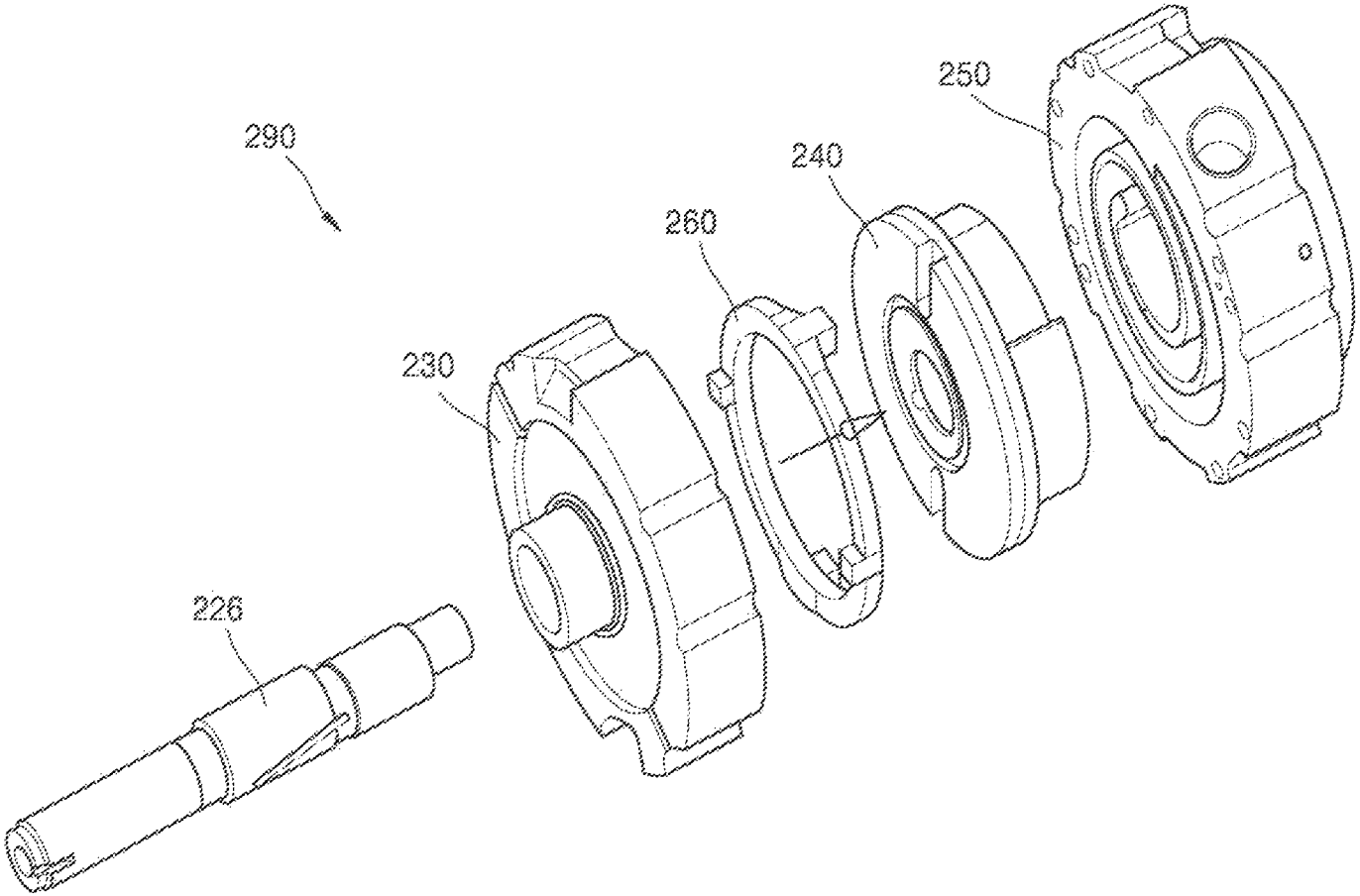
FIGS. 8A and 8B are exploded perspective views of a compressor unit of the compressor of FIG. 7.
Figure 8B:
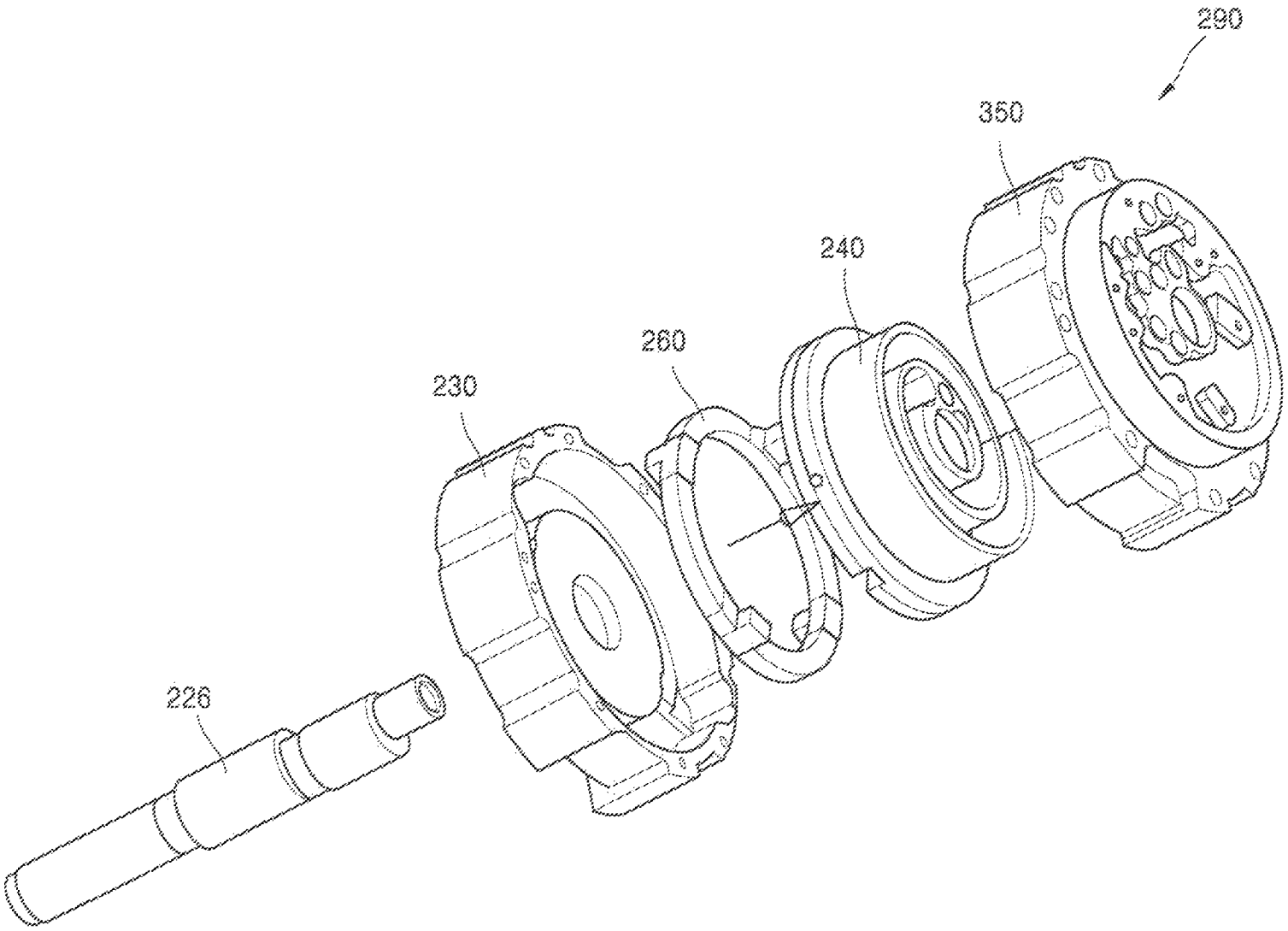

FIG. 7 is a cross-sectional view of a compressor according to another embodiment. FIGS. 8A-8B are exploded perspective views of a compressor unit of the compressor of FIG. 7. Referring to FIG. 2, the compressor 200 according to this embodiment may include a lower compression structure in which the compression unit 290 is positioned below the drive motor 220.

The compressor 200 may include a casing 210 having an inner space, the drive motor 220 provided at an upper portion of the inner space, the compression unit 290 disposed or provided at a lower end of the drive motor 220, and a rotary shaft 226 that transmits a drive force of the drive motor 220 to the compression unit 290. The inner space of the casing 210 may be divided into a first space V1 at an upper side of the drive motor 220, a second space V2 between the drive motor 220 and the compression unit 290, a third space V3 partitioned by a discharge cover 270, and an oil storage space V4 at a lower side of the compression unit 290.

The casing 210 may be, for example, in a cylindrical shape, so that the casing 210 may include a cylindrical shell 211. An upper shell 212 is provided on or at an upper portion of the cylindrical shell 211 and a lower shell 214 may be provided on or at a lower portion of the cylindrical shell 211. The upper and lower shells 212 and 214 may be joined to the cylindrical shell 211 by, for example, welding to form the inner space.

The upper shell 212 may be provided with a refrigerant discharge pipe 216. The refrigerant discharge pipe 216 may be a passage through which a compressed refrigerant discharged from the compression unit 290 to the first space V1 and the second space V2 may be discharged to the outside.

The lower shell 214 may form the oil storage space V4. The oil storage space V4 may function as an oil chamber for supplying oil to the compression unit 290 so that the compressor may be smoothly operated.

A refrigerant suction pipe 218 may be provided on or at a side surface of the cylindrical shell 211, which may be a passage through which the refrigerant to be compressed may be introduced. Although not shown in the drawing, the refrigerant suction pipe 218 may be installed or provided to penetrate up to the compression chamber S1 along a side surface of a fixed scroll 250.

The drive motor 220 may be installed or provided on or at an upper side inside of the casing 210. More specifically, the drive motor 220 may include a stator 222 and a rotor 224.

The stator 222 may be formed in for example, a cylindrical shape and fixed to the casing 210. A plurality of slots may be formed in an inner circumferential surface of the stator 222 along a circumferential direction so that coils may be wound. A refrigerant flow path groove 212*a* may be formed on an outer circumferential surface of the stator 222 so as to be cut into a D-cut shape so that the refrigerant or oil discharged from the compression unit 290 may pass through the refrigerant flow path groove 212*a*.

The rotor 224 may be coupled to an inside of the stator 222 and generate a rotational force. That is, the rotary shaft 226 may be press-fitted into a center of the rotor 224 so trial the rotor 224 may rotate together with the rotary shaft 226. The rotational force generated by the rotor 224 may be transmitted to the compression unit 290 through the rotary shaft 226.

The compression unit 290 may include a main frame 230, the fixed scroll 250, an orbiting scroll 240, and a discharge cover 270. The main frame 230 may be provided at a lower portion of the drive motor 220, and form an upper portion of the compression unit 290.

The main frame 230 may be provided with a circular frame end plate 232 (hereinafter, referred to as a "first end plate"), a frame shaft receiving portion 232*a* (hereinafter, referred to as a "first shaft-receiving portion") provided at a center of the first end plate 232 and through which the rotary shaft 226 may pass, and a frame side wall 231 (hereinafter, referred to as a "first side wall") that protrudes upward from an outer circumferential portion of the first end plate 232. An outer peripheral portion of the first side wall 231 may be brought into contact with an inner circumferential surface of the cylindrical shell 211 and a lower end portion of the first side wall 231 may be brought into contact with an upper end portion of a fixed scroll side wall 255.

The first side wall 231 may be provided with a frame discharge bole 231*a* (hereinafter, referred to as a "first hole") that passes through an inside of the first side wall 231 in an axial direction to form a refrigerant passage. An inlet of the first hole 231*a* may be connected to an outlet of a fixed scroll discharge hole 256*b*, and an outlet of the first hole 231*a* may be connected to the second space V2.

The first shaft-receiving portion 232*a* may protrude from an upper surface of the first end plate 232 toward the drive motor 220 side. A first hearing portion of the rotary shaft 226 may be formed in the first shaft-receiving portion 232*a* such that a main hearing portion 226*c* of the rotary shaft 226 may pass through the first bearing portion and be supported. That is, the first shaft-receiving portion 232*a*, through which the main bearing portion 226*c* of the rotary shaft 226 constituting the first bearing portion is rotatably inserted and supported, may axially pass through a center of the main frame 230.

An oil pocket 232*b* to collect oil discharged between the first shaft-receiving portion 232*a* and the rotary shaft 226 may be formed on an upper surface of the first end plate 232. The oil pocket 232*b* may be engraved on the upper surface of the first end plate 232, and formed in an annular shape along an outer peripheral surface of the first shaft-receiving portion 232*a*. In addition, a space may be formed on or at a bottom surface of the main frame 230 together with the fixed scroll 250 and the orbiting scroll 240 so that an intermediate pressure chamber S2 may be formed to support the orbiting scroll 240 by a pressure of the space.

The intermediate pressure chamber S2 may include an intermediate pressure region, and an oil supply flow path 226*a* provided in the rotary shaft 226 may include a high pressure region having a pressure higher than a pressure of the intermediate pressure chamber S2. A back pressure seal 237 may be provided between the main frame 230 and the orbiting scroll 240 to distinguish between the high pressure region and the intermediate pressure region. The back pressure seal 237 may serve as a sealing member or seal.

The main frame 230 may be coupled with the feed scroll 250 to form a space in which the orbiting scroll 240 may be rotatably installed or provided. Such a structure may be a structure that wraps around the rotary shaft 226 so that the rotational force may be transmitted to the compression unit 290 via the rotary shaft 226.

The fixed scroll 250, which constitutes a first scroll, may be coupled to a bottom surface of the main frame 230. The fixed scroll 250 may include a circular fixed end plate 252 (hereinafter, referred to as a "second end plate"), a fixed scroll side wall 255 (hereinafter, referred to as "a second side wall") that protrudes upward from an outer peripheral portion of the second end plate 252, a fixed wrap 251 that protrudes from an upper surface of the second end plate 252 and engaged with an orbiting wrap 241 of the orbiting scroll 240 to form a compression chamber S1, and a fixed scroll shaft-receiving portion 254 (hereinafter, referred to as a "second shaft-receiving portion") formed on or at a center of a rear surface of the second end plate 252 and through which the rotary shaft 226 may pass.

An outer peripheral portion of the second side wall 255 may be brought into contact with the inner circumferential surface of the cylindrical shell 211, and an upper end portion of the second side wall portion 255 may be brought into contact with a lower surface of the first side wall 231. The second side wall 255 may be provided with a fixed scroll groove 256*a* which may be engraved on an outer circumferential surface thereof along the axial direction and opened at both sides in the axial direction to form an oil passage. The fixed scroll groove 256*a* may be formed to correspond to a first hole 231*a* of the main frame 230. An inlet of the fixed scroll groove 256*a* may be connected to an outlet of the first hole 231*a* and an outlet thereof may be connected to the oil storage space V4.

An integrated flow path 253 may be formed in the second end plate 252 of the fixed scroll 250 and connect the intermediate pressure chamber S2 and the compression chamber S1. One or a first end of the integrated flow path 253 may be connected to the intermediate pressure chamber S2 and the other or a second end thereof may be connected to the compression chamber S1.

The integrated flow path 253 may connect the intermediate pressure chamber S2 and the compression chamber S1, thereby supplying oil fed to the intermediate pressure chamber S2 to the compression chamber S1. In addition, the integrated flow path 253 may guide a refrigerant gas compressed at a high pressure in the compression chamber S1 to the intermediate pressure chamber S2, and form an intermediate pressure corresponding to an average of a suction pressure and a discharge pressure in the intermediate pressure chamber S2. The pressure formed in the intermediate pressure chamber S2 may act as a back pressure to press an upper surface of the orbiting scroll 240.

That is, the integrated flow path 253 may be used as an oil flow path for providing oil and an intermediate pressure flow path for forming an intermediate pressure. Accordingly, according to embodiments, the flow path of the compression unit may be simplified by integrating the oil flow path and the refrigerant gas flow path into one.

The integrated flow path 253 will be discussed hereinafter with reference to FIGS. 9 and 10.

The second shaft-receiving portion 254 may protrude from a lower surface of the second end plate 252 toward the oil storage space V4 side. The second shaft-receiving portion 254 may be provided with a second bearing portion such that a sub bearing portion 226*g* of the rotary shaft 226 may be inserted into the second bearing portion and supported. A lower end portion of the second shaft-receiving portion 264 may be bent toward a center of the rotary shaft 226 to support a lower end of the sub bearing portion 226*g* of the rotary shaft 226 to form a thrust bearing surface.

The orbiting scroll 240 coupled to the rotary shaft 226 to perform an orbiting motion may be installed or provided between the main frame 230 and the fixed scroll 250. The orbiting scroll 240 may include a circular turning end plate 242 (hereinafter, referred to as a "third end plate"), the orbiting wrap 241 that protrudes from a lower surface of the third end plate 242 and engaged with the fixed wrap 251, and a rotary shaft coupler 244 provided at a center of the third end plate 242 and rotatably coupled to an eccentric portion 226*f* of the rotary shaft 226.

The orbiting scroll 240 may include a differential pressure oil supply flow path 245 formed in the third end plate 242. The differential pressure oil supply flow path 245 may be formed inside of the third end plate 242 of the orbiting scroll 240 so as to connect the intermediate pressure chamber S2 and the oil introduction chamber S3.

The differential pressure oil supply flow path 245 will be discussed hereinafter with reference to FIGS. 9 and 10.

In a case of the orbiting scroll 240, an outer circumferential portion of the third end plate 242 may be positioned at the upper end portion of the second side wall 255, and a lower end portion of the orbiting wrap 241 may be in close contact with the upper surface of the second end plate 252 and supported by the fixed scroll 250. An outer circumferential portion of the rotary shaft coupler 244 may be connected to the orbiting wrap 241 to form the compression chamber S1 together with the fixed wrap 251 during the compression process. The fixed wrap 251 and the orbiting wrap 241 may be formed in an involute shape. The involute shape means a curved line corresponding to a locus drawn by an end portion of a thread when the thread wound around a base circle having an arbitrary radius is released. However, the shapes of the fixed wrap 251 and the orbiting wrap 241 are not limited thereto.

The eccentric portion 226*f* of the rotary shaft 226 may be inserted into the rotary shaft coupler 244. The eccentric portion 226*f* may be coupled to the orbiting wrap 241 or the fixed wrap 251 so as to overlap in a radial direction of the compressor.

The rotary shaft 226 may be coupled to the drive motor 220 and include the oil supply flow path 226*a* to guide the oil contained in the oil storage space V4 of the casing 210 upward. More specifically, a lower portion of the rotary shaft 226 may be coupled to the compression unit 290 and supported in the radial direction while an upper portion thereof is press-fitted into the center of the rotor 224.

Thus, the rotary shaft 226 may transmit the rotational force of the drive motor 220 to the orbiting scroll 240 of the compression unit 290. Then, the orbiting scroll 240 eccentrically coupled to the rotary shaft 226 may perform an orbiting motion with respect to the fixed scroll 250.

The main bearing portion 226*c* may be formed in the lower portion of the rotary shaft 226 to be inserted into the first shaft-receiving portion 232*a* of the main frame 230 and radially supported. The sub bearing portion 228*g* may be formed in a lower portion of the main bearing portion 226*c* to be inserted into the second shaft-receiving portion 254 of the fixed scroll 250 and radially supported. The eccentric portion 226*f* may be formed between the main bearing portion 226*c* and the sub bearing portion 226*g* so as to be inserted into the rotary shaft coupler 244 of the orbiting scroll 240 and coupled therewith.

The main bearing portion 226*c* and the sub bearing portion 226*g* may be coaxially formed so as to have a same axial center, and the eccentric portion 226*f* may be formed eccentrically in the radial direction with respect to the main bearing portion 226*c* or the sub bearing portion 226*g*.

The eccentric portion 226*f* may have an outer diameter smaller than an outer diameter of the main bearing portion 226*c* and larger than an outer diameter of the sub bearing portion 220*g*. In this case, the rotary shaft 226 may pass through each of the shaft-receiving portions 232*a* and 254 and the rotary shaft coupler 244 to be coupled therewith.

Alternatively, the eccentric portion 226*f* may not be integrally formed with the rotary shaft 226 but may be formed using a separate bearing. In this case, the outer diameter of the sub bearing portion 228*g* is not smaller than the outer diameter of the eccentric portion 226*f*, but the rotary shaft 226 may be inserted into each of the shaft-receiving portions 232*a* and 254 and the rotary shaft coupler 244.

The oil supply flow path 226*a* for supplying the oil in the oil storage space V4 to surfaces of the bearing portions 228*c* and 228*g* and a surface of the eccentric portion 226*f* may be formed inside of the rotary shaft 226. In addition, oil holes 226*b*, 226*d*, and 226*e* that pass from the oil supply flow path 226*a* to an outer circumferential surface may be formed in the bearing portion 226*c* and 226*g* of the rotary abaft 226 and the eccentric portion 226*f* of the rotary shaft 226. More specifically, the oil holes may include a first oil hole 226*b*, a second oil hole 226*d*, and a third oil hole 226*e*.

The first oil hole 226*b* may pass through an outer peripheral surface of the main bearing portion 226*c*. More specifically, the first oil bole 226*b* may pass from the oil supply flow path 226*a* to an outer peripheral surface of the main bearing portion 226*c*. Further, the first oil hole 226*b* may pass through, for example, an upper portion of the outer peripheral surface of the main bearing portion 226*c*. However, embodiments are not limited thereto, and the first oil hole 226*b* may pass through a lower portion of the outer peripheral surface of the main hearing portion 226*c*.

In addition, the first oil hole 226*b* may include a plurality of holes, unlike that shown in the drawings. When the first oil hole 226*b* includes a plurality of holes, the holes may be formed only in the upper or lower portion of the outer peripheral surface of the main bearing portion 226*c*, or formed in the upper and lower portions of the outer peripheral surface of the main bearing portion 228*c*, respectively. However, for convenience of description, in this embodiment, the first oil hole 226*b* includes one hole.

A slant line or spiral-shaped first oil groove G1, one or a first end of which may be connected to the first oil hole 226*b*, may be formed on the outer peripheral surface of the main bearing portion 226*c*. More specifically, the first end of the first oil groove G1 may be connected to the first oil hole 226*b*, so that a portion of the oil discharged from the first oil hole 226*b* may be supplied to the outer peripheral surface of the main bearing portion 226*c* along the first oil groove G1. That is, a portion of the oil discharged from the first oil hole 226*b* may flow along the first oil groove G1 and be supplied to upper, lower, and lateral sides of the outer peripheral surface of the main bearing portion 226*c*. The remaining oil discharged from the first oil hole 226*b* may be directly supplied to the upper, lower, and lateral sides of the outer peripheral surface of the main bearing portion 226*c* with respect to the first oil hole 226*b*.

In addition, the first oil groove G1 may be inclined in a relational direction of the rotary shaft 226 or in a direction opposite to the rotational direction. That is, the first oil groove G1 may extend in a diagonal direction between the axial direction and the rotational direction (or the direction opposite to the relational direction) of the rotary shaft 226.

The first oil groove G1 may include a plurality of grooves, unlike that shown in the drawings. For example, when the first oil groove G1 includes a plurality of grooves and the first oil hole 226*b* includes one or a first hole, one or a first end of each groove may be connected to the first oil hole 226*b*.

In addition, when the first oil groove G1 includes a plurality of grooves and the first oil hole 226*b* also includes a plurality of holes, one or a first end of each groove may be formed so as to be connected one-to-one to each of the holes. However, for convenience of description, in this embodiment, the first oil groove G1 includes one groove.

The second oil hole 226*d* may pass through an outer peripheral surface of the eccentric portion 226*f*. More specifically, the second oil hole 226*d* may pass through from the oil supply flow path 226*a* to the outer peripheral surface of the eccentric portion 226*f*. In addition, the second oil hole 226*d* may pass through, for example, an intermediate portion of the outer peripheral surface of the eccentric portion 226*f*. However, embodiments are not limited thereto, and the second oil hole 226*d* may pass through an upper or lower portion of the outer peripheral surface of the eccentric portion 226*f*.

The second oil hole 226*d* may include a plurality of holes, unlike that shown in the drawings. When the second oil hole 226*d* includes a plurality of holes, each of the holes may be formed only in a middle portion of the outer peripheral surface of the eccentric portion 226*f* or formed in the upper and lower portions of the outer peripheral surface of the eccentric portion 226*f*, respectively. However, for convenience of description, in this embodiment, the second oil hole 226*d* includes one hole.

The third oil hole 228*e* may be formed on the sub bearing portion 226*g*. More specifically, the third oil hole 226*e* may pass through from the oil supply flow path 226*a* to an outer peripheral surface of the sub bearing portion 226*g*. Further, the third oil hole 226*e* may pass through, for example, a middle portion of the outer peripheral surface of the sub bearing portion 226*g*. However, embodiments are not limited thereto, and the third oil hole 226*e* may pass through an upper or lower portion of the outer peripheral surface of the sub bearing portion 226*g*.

The third oil hole 226*e* may include a plurality of holes, unlike that shown in the drawings. In addition, when the third oil hole 226*e* includes a plurality of holes, each of the holes may be formed only in a middle portion of the outer peripheral surface of the sub bearing portion 226*g*, or formed in the upper and lower portions of the outer peripheral surface of the sub bearing portion 226*g*, respectively. However, for convenience of description, in this embodiment, the third oil hole 226*e* includes one hole.

A second oil groove G2 may be formed on the outer peripheral surface of the sub bearing portion 226*g* so as to be connected to the third oil hole 226*e* and extend in the vertical direction. More specifically, the third oil hole 226*e* may be formed at a center of the second oil groove G2, so that a portion of the oil discharged from the third oil hole 226*e* may be efficiently supplied to the outer circumferential surface of the sub bearing portion 226*g* along the second oil groove G2. That is, a portion of the oil discharged from the third oil hole 226*e* may flow along the second oil groove G2 and be supplied to upper, lower, and lateral sides of the outer peripheral surface of the sub bearing portion 226*g*.

The remaining oil discharged from the third oil hole 226*a* may be directly supplied to the upper, lower, and lateral sides of the outer peripheral surface of the sub bearing portion 226*g* with respect to the third oil hole 226*e*. Of course, the second oil hole 226*d* may be formed on or at the upper or lower portions of the second oil groove G2. Further, the second oil groove G2 may be straight in the vertical direction, that is, the longitudinal direction, as shown in the drawing, but may be formed to be inclined or spirally formed along the longitudinal direction.

The second oil groove G2 may include a plurality of grooves, unlike that shown in the drawings. For example, when the second oil groove G2 includes a plurality of grooves and the third oil hole 226*e* also includes a plurality of holes, each hole may be formed at a center of each groove. However, for convenience of description, in this embodiment, the second oil groove G2 includes one groove.

As a result the oil guided upward through the oil supply flow path 226*a* may be discharged through the first oil hole 226*b* and entirely supplied to the outer peripheral surface of the main bearing portion 226*c*. In addition, the oil discharged through the first oil hole 226*b* may move to the lower portion of the main bearing portion 226*c* along the first oil groove G1 and be supplied to the upper surface of the orbiting scroll 240.

The oil guided upward through the oil supply flow path 226*a* may be discharged through the second oil hole 226*d* and entirely supplied to the outer peripheral surface of the eccentric portion 226*f*. In addition, the oil guided upward through the oil supply flow path 226*a* may be discharged through the third oil hole 226*e* and supplied to the outer peripheral surface of the sub bearing portion 226*g*.

An oil feeder 271 that pumps oil stored in the oil storage space V4 may be coupled to a lower end of the sub bearing portion 226*g*. The oil feeder 271 may include an oil supply pipe 273 inserted into and coupled to the oil supply flow path 226*a* of the rotary shaft 226, and an oil absorption member 274 inserted into the oil supply pipe 273 to absorb oil. The oil supply pipe 273 may pass through a through-hole 276 of the discharge cover 270 to be submerged in the oil-storage space V4, and the oil absorption member 274 may function as a propeller.

Further, although not shown in the drawings, a trochoid pump (not shown) to forcibly pump upward the oil stored in the oil storage space V4 instead of the oil feeder 271 may be coupled to the sub bearing portion 226*g*. Furthermore, although not shown in the drawings, the compressor 200 according to an embodiment may further include a first sealing member or seal (not shown) that seals a gap between an upper end of the main bearing portion 226*c* and an upper end of the main frame 230 and a second sealing member or seal (not shown) that seals a gap between a lower end of the sub bearing portion 226*g* and a lower end of the fixed scroll 250. It is possible to prevent the oil from flowing out of the compression unit 290 along a bearing surface, that is, an outer peripheral surface of the bearing portion, through the first and second sealing members or seals. This makes it possible to implement a differential pressure oil supply structure and prevent backflow of the refrigerant.

A balance weight 227 that suppresses noise and vibration may be coupled to the rotor 224 or the rotary shaft 226. The balance weight 227 may be provided between the drive motor 220 and the compression unit 290, that is, in the second space V2.

Hereinafter, an operation of a scroll compressor according to an embodiment will now be described.

When power is applied to the drive motor 220 to generate a rotational force, the rotary shaft 226 coupled to the rotor 224 of the drive motor 220 rotates. Then, the orbiting scroll 240 eccentrically connected to the rotary shall 226 may perform an orbiting motion with respect to the fixed scroll 250 to form the compression chamber S1 between the orbiting wrap 241 and the fixed wrap 251.

Next, the refrigerant supplied from the outside of the casing 210 through the refrigerant suction pipe 218 may be directly introduced into the compression chamber S1. The refrigerant may be compressed while moving in a direction of a discharge chamber of the compression chamber S1 by the orbiting motion of the orbiting scroll 240, and discharged to the third space V3 via a discharge port 257*a* of the fixed scroll 250 in the discharge chamber. Then, the compressed refrigerant discharged to the third space V3 may be discharged to the inner space of the casing 210 via discharge holes 257*b* and 257*c* and refrigerant flow path 212*a* and discharged to the outside of the casing 210 through the refrigerant discharge pipe 216.

Hereinafter, an integrated flow path structure of the compressor unit of the compressor of FIG. 7 will be described with reference to FIGS. 9 and 10.

Figure 9:
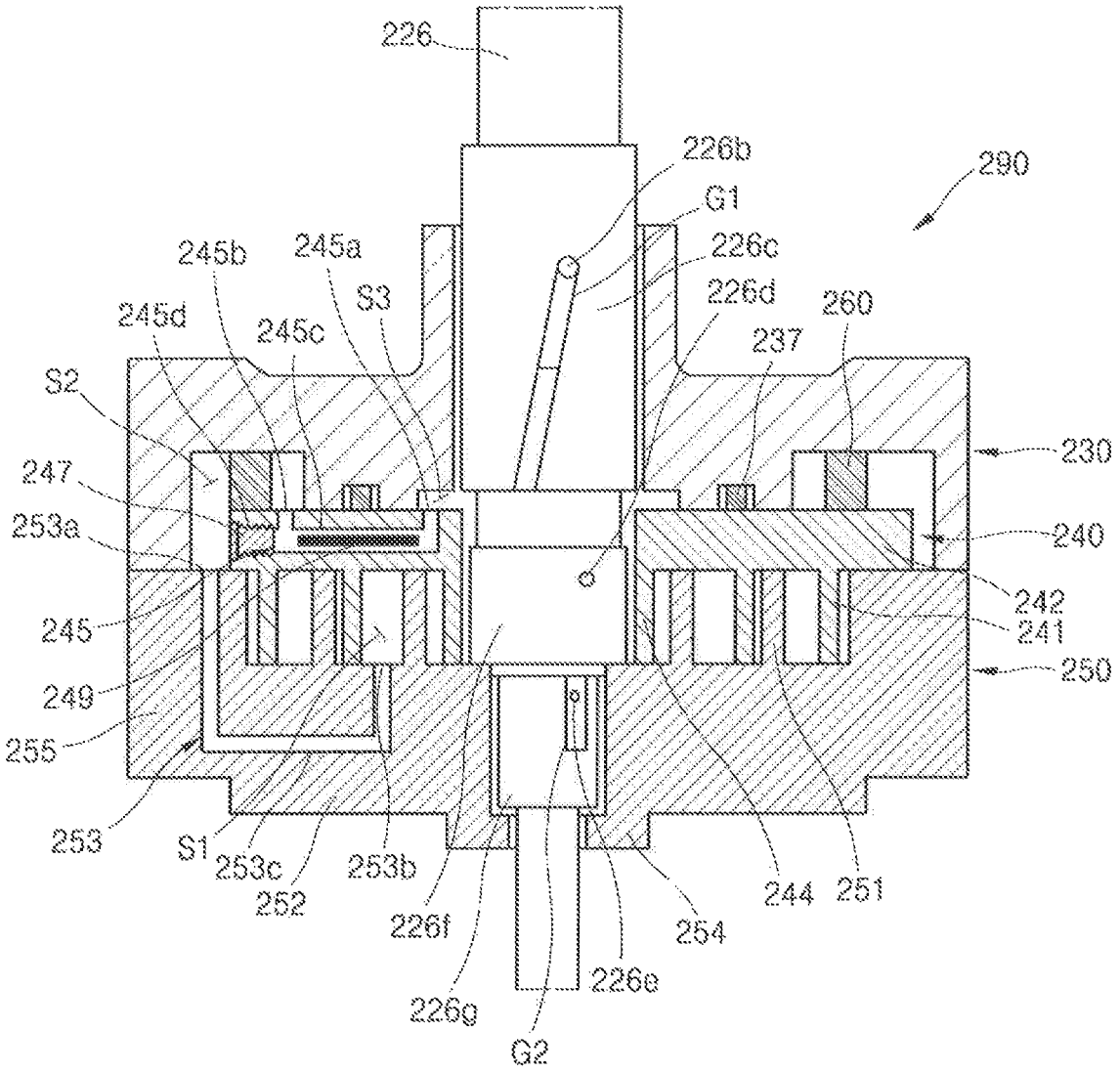
FIGS. 9 and 10 are partial cross-sectional views of an integrated flow path structure of the compressor of FIG. 7 according to another embodiment.
Figure 10:
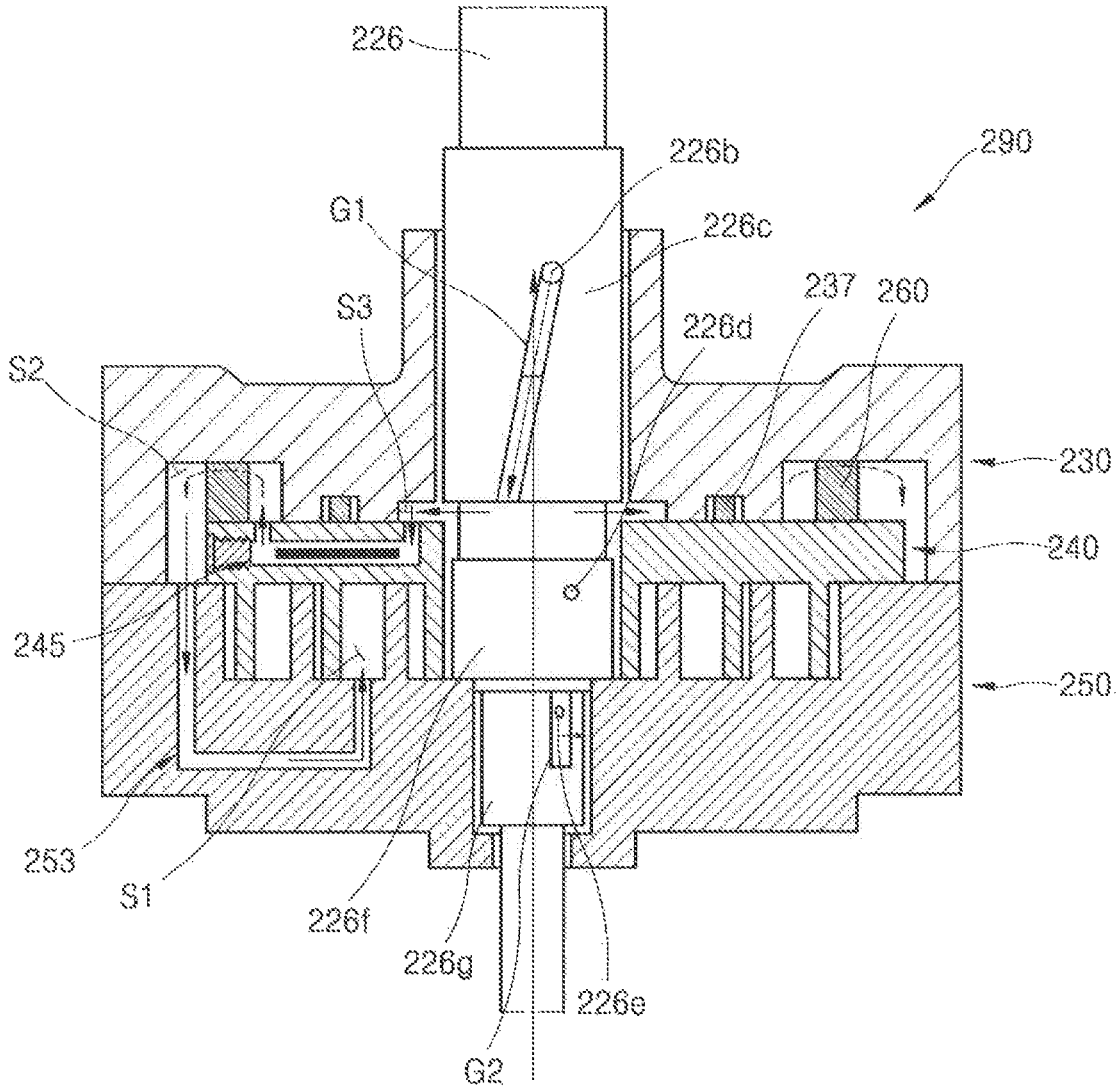

FIGS. 9 and 10 are partial cross-sectional views of an integrated flow path structure of the compressor unit of the compressor of FIG. 7 according to another embodiment. FIG. 9 shows structures of the differential pressure oil supply flow path and the integrated flow path. FIG. 10 shows an oil flow according to the differential pressure oil supply flow path and the integrated flow path.

More specifically, the oil stored in the oil storage space V4 may be guided, that is, moved or supplied, upward through the oil supply flow path 226*a* of the rotary shaft 226. As shown in FIG. 9, the oil guided upward through the oil supply flow path 226*a* may be discharged through the first oil hole 226*b*, and entirely supplied to the outer peripheral surface of the main bearing portion 226*c*.

The oil discharged through the first oil hole 226*b* may be supplied to the upper surface of the orbiting scroll 240 by moving along the first oil groove G1. The oil guided upward through the oil supply flow path 226*a* may be discharged through the second oil hole 226*d*, and entirely supplied to the outer peripheral surface of the eccentric portion 226*f*.

The oil guided upward through the oil supply flow path 226*a* may be discharged through the third oil hole 226*e*, and supplied to the outer peripheral surface of the sub bearing portion 226*g* or between the orbiting scroll 240 and the fixed scroll 250. In this way, the oil contained in the oil storage space V4 may be guided upward through the rotary shaft 226 and smoothly supplied to the bearing portion, that is, the bearing surface through the plurality of oil holes 226*b*, 226*d*, and 226*e*, so that wear of the bearing portion may be prevented.

The oil discharged through the plurality of oil holes 226*b*, 226*d*, and 226*e* may form an oil film between the fixed scroll 250 and the orbiting scroll 240 to maintain an airtight state. Further, the oil discharged through the plurality of oil holes 226*b*, 226*d*, and 226*e* may absorb frictional heat generated by friction and dissipate heat in the high-temperature compression unit 290.

A portion of the high-pressure oil discharged through the oil holes 226*b*, 226*d* and 226*e* may move to the oil introduction chamber S3 formed between the main frame 230 and the orbiting scroll 240. A portion of the oil supplied to the oil introduction chamber S3 may be supplied to the outer peripheral surface of the main bearing portion 226*c*, the eccentric portion 226*f*, or the sub bearing portion 226*g*, or supplied between the orbiting scroll 240 and the fixed scroll 250.

Another portion of the oil supplied to the oil introduction chamber S3 may be supplied to the intermediate pressure chamber S2 through the differential pressure oil supply flow path 245 of the orbiting scroll 240. More specifically, the differential pressure oil supply flow path 245 may include a first hole 245*a*, a second hole 245*b*, and a horizontal passage 245*c*. The first hole 245*a* may be formed on an upper surface of the third end plate 242 and disposed close to a center axis of the orbiting scroll 240 so as to be connected to the oil introduction chamber S3. The first hole 245*a*, may be formed of a plurality of holes; however, embodiments are not limited thereto.

The second hole 245*b* may be formed on the upper surface of the third end plate 242 and disposed close to an outer peripheral surface of the orbiting scroll 240 so as to be connected to the intermediate pressure chamber S2. Similarly, the second hole 245*b* may be formed of a plurality of holes; however, embodiments are not limited thereto.

The horizontal flow path 245*c* may connect the first hole 245*a* and the second hole 245*b* and be formed on an inner side of the third end plate 242 so as to extend parallel to the upper surface of the third end plate 242. Additionally, an opening 245*d* for opening a portion of a side surface of the third end plate 242 may be formed at one side of the first horizontal passage 245*c*. An inner surface of the opening 245*d* may be formed with a screw groove which may be fastened to the coupling bolt 247. However, embodiments are not limited thereto, and the inner surface of the opening 245*d* may be formed in various shapes which may be fastened to the coupling bolt 247, such as a stepped shape or a curved shape.

The opening 245*d* may be used to insert a decompression pin 249 into the first horizontal flow path 245*c*. That is, the decompression pin 249 may be disposed inside of the differential pressure oil supply flow path 245. A diameter of the decompression pin 249 may be smaller than a diameter of the first horizontal flow path 245*c*. Accordingly, the decompression pin 249 may adjust a pressure and an amount of supply of oil in the differential pressure oil supply flow path 245 by forming a narrow flow path through which oil may move in the differential pressure oil supply flow path 245.

Although not clearly shown in the drawings, other shaped-decompression pins or members for forming a narrow flow path in the differential pressure oil supply flow path 245 may be used instead of the decompression pin 249. For example, a cylindrical or polyhedral decompression pin may be used; however, embodiments are not limited thereto. However, for convenience of description, in this embodiment, an example in which the decompression pin 249 is provided in the differential pressure oil supply flow path 245 will be described.

After the decompression pin 249 is inserted into the first horizontal flow path 245*c*, the coupling bolt 247 may be fastened to the opening 245*d*. The coupling bolt 247 may be formed in a shape which may be coupled to the opening 245*d*. For example, the coupling bolt 247 may be formed in a threaded, stepped, or curved shape corresponding to an inner shape of the opening 245*d*. In addition, the coupling bolt 247 may be any one of a bolt (applying a fastening method), a rod (applying an indentation method), and a ball (applying an indentation method); however, embodiments are not limited thereto.

As the coupling belt 247 is coupled to the opening 245*d*, the differential pressure oil supply flow path 245 having a shape "⊏" connecting the oil introduction chamber S3 and the intermediate pressure chamber S2 may be formed in the orbiting scroll 240. However, embodiments are not limited thereto, and the shape of the differential pressure oil supply flow path 245 may be variously formed in an S shape or a "ㄴ" shape.

The oil which has passed through the differential pressure oil supply flow path 245 to be discharged to the intermediate pressure chamber S2 may be supplied to a thrust surface between the orbiting scroll 240 and the fixed scroll 250. In addition, the discharged oil may be provided to an Oldham's ring 260 provided between the orbiting scroll 240 end the main frame 230 to prevent the orbiting scroll 240 from rotating. The oil discharged into the intermediate pressure chamber S2 may be supplied between the respective components of the compression unit 290 to reduce the friction of the compression unit 290.

Additionally, although not shown in the drawings, a plurality of differential pressure oil supply flow paths 245 may be formed in the orbiting scroll 240. Further, the plurality of differential pressure oil supply flow paths 246 may be disposed or provided in the orbiting scroll 240 at regular intervals. A number of the differential pressure oil supply flow paths 245 may be equal to a number of the integrated flow paths 253.

Further, the plurality of differential pressure oil supply flow paths 245 may be formed so as to correspond one-to-one to the plurality of integrated flow paths 253. However, embodiments are not limited thereto.

The oil guided to the intermediate pressure chamber S2 may be provided on the thrust surface between the orbiting scroll 240 and the fixed scroll 250. The oil guided to the intermediate pressure chamber S2 may be supplied to the Oldham's ring 260 provided between the orbiting scroll 240 and the main frame 230 and the thrust surface of the fixed scroll 250.

That is, the oil introduced into the intermediate pressure chamber S2 may be sufficiently provided to the thrust surface between the orbiting scroll 240 and the fixed scroll 250 and the Oldham's ring 260. Accordingly, wear of the thrust surface of the fixed scroll 250 and the Oldham's ring 260 may be reduced.

The oil guided to the intermediate pressure chamber S2 may be guided to the integrated flow path 253 provided in the fixed scroll 250. The integrated flow path 253 may pass through the second side wall 255 and the second end plate 252.

More specifically, the integrated flow path 253 may include a third hole 253*a*, a fourth hole 253*b*, and a horizontal flow path 253*c*. The third hole 253*a* may be formed on an upper surface of the second side wall 255 and connected to the intermediate pressure chamber S2. The third hole 253*a* may be formed of a plurality of holes; however, embodiments are not limited thereto.

The fourth hole 253*b* may be formed on an upper surface of the second end plate 252 and connected to the compression chamber S1. Similarly, the fourth hole 253*b* may be formed of a plurality of holes; however, embodiments are not limited thereto.

The horizontal flow path 253*c* may connect the third bole 253*a* and the fourth hole 253*b*, and be formed on an inner side of the second end plate 252 so as to be parallel to one surface of the second end plate portion 252. Further, the integrated flow path 253 may be formed to pass through only the second side wall 255, in this case, a length of the integrated flow path 253 may be shorter in comparison with a case so which the integrated flow path 253 is formed to pass through both the second side wall 255 and the second end plate 252. The integrated flow path 253 may be formed in a "¬" or "⊏" shape in the second end plate 252 of the fixed scroll 250; however embodiments are not limited thereto.

Additionally, although not shown in the drawings, a plurality of integrated flow paths 253 may be formed in the fixed scroll 250. In addition, the plurality of integrated flow paths 253 may be disposed or provided in the fixed scroll 250 at regular intervals. A number of the integrated flow paths 250 may be a same as a number of the differential pressure oil supply flow path 245. However, embodiments are not limited thereto.

Accordingly, one or a first end of the integrated flow path 253 may communicate with the intermediate pressure chamber S2, and the other or a second end thereof may communicate with the compression chamber S1. Thus, the oil guided to the integrated flow path 253 may be supplied to the compression chamber S1. In this way, the oil contained in the oil storage space V4 may be smoothly supplied to the compression chamber S1 through the differential pressure oil supply flow path 245 and the integrated flow path 253.

Further, the oil may be smoothly supplied to the compression chamber S1, so that wear due to friction between the orbiting scroll 240 and the fixed scroll 250 may be reduced, thereby improving compression efficiency. Furthermore, the oil supplied to the compression chamber S1 may form an oil film between the fixed scroll 250 and the orbiting scroll 240 to maintain an airtight state of the compression chamber S1. Also, the oil supplied to the compression chamber S1 may absorb frictional heat generated during the occurrence of friction between the fixed scroll 250 and the orbiting scroll 240 to dissipate heat.

The integrated flow path 253 may move the refrigerant gas compressed at a high pressure in the compression chamber S1 to the intermediate pressure chamber S2 to form an intermediate pressure between a suction pressure and a discharge pressure in the intermediate pressure chamber S2, and thereby a back pressure may be formed on an upper surface of the orbiting scroll 240. That is, the compressor 200 according to this embodiment may integrate the intermediate pressure flow path and the differential pressure oil supply flow path, which are formed in the fixed scroll 250 in the conventional compressor, into one integrated flow path 253.

The integrated flow path 253 may be used as an intermediate pressure flow path for forming a back pressure to press the orbiting scroll 240 in a direction of the fixed scroll 250. In addition, the integrated flow path 253 may also be used as a differential pressure oil supply flow path for transmitting the oil discharged into the intermediate pressure chamber S2 to the compression chamber S1.

Accordingly, the number of repaired flow paths in the fixed scroll 250 used in the compressor 200 according to embodiments may be reduced, in comparison to the prior art. Thus, the manufacturing process for producing the fixed scroll 250 may be simplified, and the manufacturing time reduced. Further, as the manufacturing process and time are reduced, manufacturing costs of the compressor 200 may be reduced.

Furthermore, vibration and noise due to friction generated when a plurality of flow paths are formed in the fixed scroll 250 may be reduced by reducing the number of flow paths in the fixed scroll 250. Also, by reducing vibration and noise generated during operation of the compressor 200, operational stability of the compressor 200 may be increased, and a user's satisfaction may also be enhanced.

Hereinafter, an integrated flow path structure of the compressor unit of the compressor of FIG. 7 according to another embodiment will be described with reference to FIG. 11.

Figure 11:
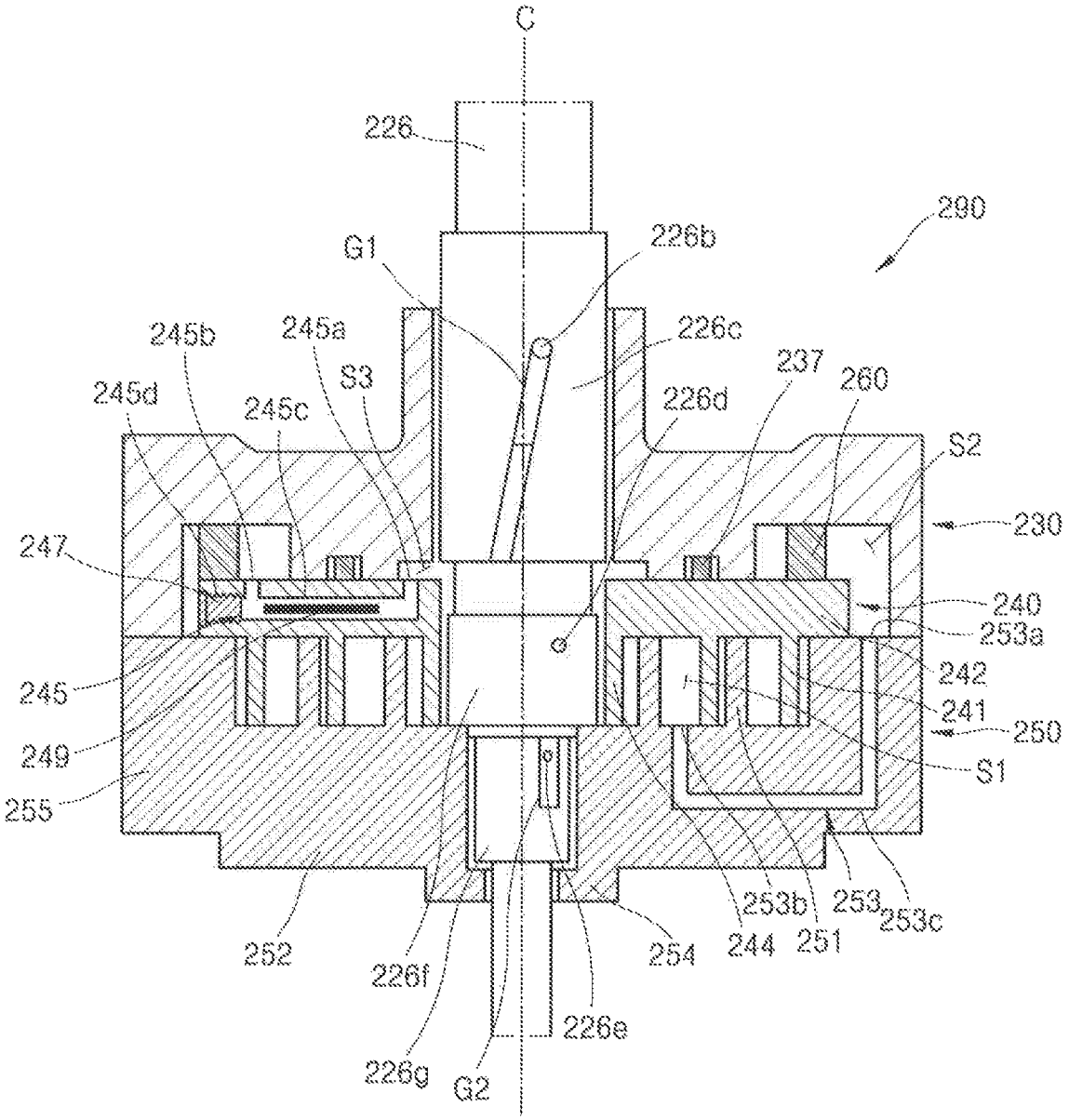
FIG. 11 is a partial cross-sectional view of an integrated flow path structure of a compression unit of the compressor of FIG. 7 according to another embodiment.

FIG. 11 is a partial cross-sectional view of an integrated flow path structure of a compression unit of the compressor of FIG. 7 according to another embodiment. However, the oil flow according to the differential pressure oil supply flow path 245 shown in FIG. 11 may be the same as that shown in FIGS. 7 to 10, and thus, repetitive description thereof has been omitted.

Referring to FIG. 11, in the compressor 200, the differential pressure oil supply flow path 245 formed in the orbiting scroll 240 may be disposed or provided on or at one or a first side of the orbiting scroll 240 with respect to the rotary shaft 226, and disposed or provided on or at the other or a second side thereof with respect to the rotary shaft 226 of the integrated flow path 253 formed in the fixed scroll 250. For example, the differential pressure oil supply flow path 245 formed in the orbiting scroll 240 may be positioned on a first side (left side in the drawing) with respect to the rotary shaft 226, and the integrated flow path 253 formed in the fixed scroll 250 may be positioned on a second side (right side in the drawing) with respect to the rotary shaft 226. That is, the differential pressure oil supply flow path 245 and the integrated flow path 253 may be positioned opposite to each other with respect to a center C of the rotary shaft 226.

Further, a first direction of the differential pressure oil supply flow path 245 extending outward from the inside of the orbiting scroll 240 may be different from a second direction of the integrated flow path 253 extending outward from the inside of the fixed scroll 250. That is, the first direction of the differential pressure oil supply flow path 245 extending outward from the Inside of the orbiting scroll 240 may be opposite from the second direction of the integrated few path 253 extending outward from the inside of the fixed scroll 250.

Although any location of the differential pressure oil supply flow path 245 and the integrated flow path 253 may be suitable, where the differential pressure oil supply flow path 245 is located opposite to the integrated flow path 253, a phenomenon where too much oil is provided at an initial operation of the compressor 200 may be prevented. That is, uniform distribution of oil may be provided, even at an initial operational the compressor 200.

Although not shown in the drawings, an angle between the first direction of the differential pressure oil supply flow path 245 extending outward from the inside of the orbiting scroll 240 and the second direction of the integrated flow path 253 extending outward from the inside of the fixed scroll 250 may be an obtuse angle. That is, the angle between the first direction A and the second direction B1 may be a value in a range of about 90 to 180 degrees.

In addition, an angle between the first direction A of the differential pressure oil supply flow path 245 extending outward from the inside of the turning scroll 240 and a third direction B2 of the integrated flow path 253 extending outward from the inside of the fixed scroll 250 may be an acute angle. That is, the angle between the first direction A and the third direction B2 may be a value in a range of about 0 to 90 degrees.

Accordingly, the oil discharged from the oil introduction chamber S3 to the intermediate pressure chamber S2 through the differential pressure oil supply flow path 245 may move along an inner peripheral surface of the intermediate pressure chamber S2. The oil discharged into the intermediate pressure chamber S2 may be uniformly supplied to the thrust surface between the orbiting scroll 240 and the fixed scroll 250 and between the orbiting scroll 240 and the main frame 230, while moving toward the integrated flow path 253 along the inner peripheral surface of the intermediate pressure chamber S2.

Next, the oil guided to the integrated flow path 253 may be supplied to the compression chamber S1. The oil may be uniformly supplied to the intermediate pressure chamber S2 and the compression chamber S1 so that the same effects as those of the previous embodiments, namely, reduction in wear, maintenance of airtight state, and heat dissipation, for example, may be obtained.

Additionally, as described above, as the number of flow paths required to be generated in the fixed scroll 250 is reduced, the manufacturing process and time may be reduced, and the manufacturing costs may be reduced. Further, vibration and noise due to friction generated when a plurality of flow paths are formed in the fixed scroll 250 may be reduced by reducing the number of flow paths generated in the fixed scroll 250.

The compressor according to embodiments disclosed herein may integrate the oil flow path and the refrigerant gas flow path into one flow path, thereby simplifying the flow path of the compression unit. Thus, the manufacturing process for producing the fixed scroll may be simplified, and the manufacturing time of the fixed scroll may be reduced. In addition, as the manufacturing process and time are reduced, manufacturing costs of the fixed scroll may also be lowered. In addition, vibration and noise due to friction caused by forming a plurality of flow paths may be reduced. Accordingly, operational stability of the compressor may be increased, and a satisfaction of a user may also be enhanced.

In addition, in the compressor according to embodiments disclosed herein, the integrated flow path in the fixed scroll and the differential pressure oil supply flow path in the orbiting scroll may be disposed or provided to be spaced apart from each other in the compression unit, so that oil may be uniformly diffused into the compression unit. As a result, oil may be sufficiently supplied between the orbiting scroll and the fixed scroll in the compression unit, thereby minimizing a frictional force generated during operation of the compressor. In addition, the operation efficiency of the compressor may be improved.

Embodiments disclosed herein are directed to a compressor which may integrate an oil flow path and a refrigerant gas flow path in a fixed scroll into one, flow path thereby simplifying the flow path of a compression unit. Embodiments disclosed herein are also directed to a compressor in which a first differential pressure oil supply flew path and a second differential pressure oil supply flow path are arranged to be spaced apart from each other in an intermediate pressure chamber so that oil discharged into the intermediate pressure chamber may be uniformly diffused in a compression unit.

A compressor according to embodiments disclosed herein may include an integrated flow path in which an oil flow path and a refrigerant gas flow path are integrated into one flow path in a fixed scroll. The integrated flow path may connect an intermediate pressure chamber and a compression chamber in a compression unit. The integrated flow path which provides a compressed refrigerant in the compression chamber to the intermediate pressure chamber and oil in the intermediate pressure chamber to the compression chamber may be formed, so that the flow path of the compression unit may be simplified.

In addition, in the compressor according to embodiments disclosed herein, a first direction of a differential pressure oil supply flow path which extends outward from an inside of an orbiting scroll may be different from a second direction of the integrated flow path which extends outward from an inside of the fixed scroll. That is, the integrated flow path and the differential pressure oil supply flow path may be disposed to be spaced apart from each other, so that the oil discharged into the intermediate pressure chamber may be uniformly diffused in the compression unit.

This application relates to U.S. application Ser. No. 15/830,135, U.S. application Ser. No. 15/830,184, U.S. application Ser. No. 15/830,222, U.S. application Ser. No. 15/830,248, and U.S. application Ser. No. 15/830,290, all filed on Dec. 4, 2017, which are hereby incorporated by reference in their entirety. Further, one of ordinary skill in the art will recognize that features disclosed in these above-noted applications may be combined in any combination with features disclosed herein.

It will be apparent to those skilled in the art that various modifications can be made to the above-described embodiments without departing from the spirit or scope. Thus, if is intended that the embodiments covers all such modifications provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily ail referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

a drive motor provided in an inner space of the casing;

a rotary shaft that transmits a rotational force generated by the drive motor;

a main frame fixed in the inner space of the casing and through which the rotary shaft passes;

a fixed scroll coupled to the main frame; and an orbiting scroll positioned between the fixed scroll and the main frame, the orbiting scroll performing an orbiting motion while being engaged with the fixed scroll and forming a compression chamber with the fixed scroll, wherein the orbiting scroll includes at least one differential pressure oil supply flow path that provides oil to an intermediate pressure chamber formed by the main frame, the fixed scroll, and the orbiting scroll, wherein the intermediate chamber is formed at an inner surface of the main frame, and wherein the fixed scroll includes at least one integrated flow path that connects the intermediate pressure chamber and the compression chamber to provide a compressed refrigerant in the compression chamber to the intermediate pressure chamber and provide oil in the intermediate pressure chamber to the compression chamber.

2. The compressor of claim 1, wherein the rotary shaft includes an oil flow path that extends in an axial direction of the rotary shaft and at least one oil hole that extends from the oil flow path in a radial direction of the rotary shaft, and wherein oil provided through the oil flow path is discharged through the at least one oil hole into an oil introduction chamber formed by the rotary shaft, the main frame, and the orbiting scroll.

3. The compressor of claim 2, wherein the at least one differential pressure oil supply flow path connects the oil introduction chamber and the intermediate pressure chamber, and provides the oil discharged into the oil introduction chamber to the intermediate pressure chamber.

4. The compressor of claim 2, wherein the orbiting scroll includes an orbiting end plate, and an orbiting wrap that protrudes from a first surface of the orbiting end plate to be coupled with a fixed wrap of the fixed scroll and perform the orbiting motion with respect to the fixed wrap, and wherein the at least one differential pressure oil supply flow path includes a first hole formed in a second surface of the orbiting end plate and connected to the oil introduction chamber, a second hole formed in the second surface of the orbiting end plate and connected to the intermediate pressure chamber, and a first horizontally extending flow path that connects the first hole and the second hole formed inside of the orbiting end plate.

5. The compressor of claim 4, wherein the orbiting scroll further includes:

an opening formed on a side surface of the orbiting end plate to open a portion of the at least one differential pressure oil supply flow path;

a decompression pin inserted into the at least one differential pressure oil supply flow path; and a coupling bolt coupled to the opening.

6. The compressor of claim 5, wherein a diameter of the decompression pin is smaller than a diameter of the at least one differential pressure oil supply flow path.

7. The compressor of claim 1, wherein the at least one integrated flow path forms a back pressure that presses the orbiting scroll in a direction of the fixed scroll, and provides the oil in the intermediate pressure chamber to the compression chamber.

8. The compressor of claim 1, wherein the fixed scroll includes a fixed end plate, a fixed wrap that protrudes from the fixed end plate, and a fixed side wall that protrudes from an outer peripheral portion of the fixed end plate, wherein the at least one integrated flow path includes a third hole formed on a first surface of the fixed side wall and connected to the intermediate pressure chamber, a fourth hole formed on a first surface of the fixed end plate and connected to the compression chamber, and wherein a second horizontal flow path that connects the third hole and the fourth hole is formed inside of the fixed end plate.

9. The compressor of claim 8, wherein the at least one integrated flow path is formed in a "□" or "⊔" shape inside of the fixed scroll.

10. The compressor of claim 1, wherein an angle between a first direction in which the at least one differential pressure oil supply flow path extends outward from the inside of the orbiting scroll and a second direction in which the at least one integrated flow path extends outward from an inside of the fixed scroll is an acute angle or an obtuse angle.

11. A compressor, comprising:

a main frame including a frame end plate, a frame shaft-receiving portion provided at a center of the frame end plate and through which a rotary shaft passes, a frame side wall that protrudes from an outer peripheral portion of the frame end plate, and an intermediate pressure chamber formed inside of the frame side wall;

a fixed scroll including a fixed end plate facing the frame end plate, a fixed wrap that protrudes from the fixed end plate, a fixed side wall that protrudes from an outer peripheral portion of the fixed end plate, and at least one integrated flow path that connects an a first surface of the fixed side wall and a first surface of the fixed end plate inside of the fixed end plate; and an orbiting scroll that includes an orbiting end plate, an orbiting wrap that protrudes from the orbiting end plate to form a compression chamber with the fixed wrap and perform an orbiting motion with respect to the fixed wrap, and at least one differential pressure oil supply flow path that provides oil discharged through at least one oil hole provided in the rotary shaft to the intermediate pressure chamber, wherein the integrated flow path connects the intermediate pressure chamber and the compression chamber to provide a compressed refrigerant in the compression chamber to the intermediate pressure chamber and provide oil in the intermediate pressure chamber to the compression chamber, wherein the intermediate chamber is formed at an inner surface of the main frame, and wherein a number of the at least one differential pressure oil supply flow paths is the same as a number of the at least one integrated flow paths.

12. The compressor of claim 11, wherein the orbiting scroll further includes an opening that opens a portion of the at least one differential pressure oil supply flow path on a side surface of the orbiting end plate, a decompression pin inserted into the at least one differential pressure oil supply flow path, and a coupling bolt coupled to the opening.

13. The compressor of claim 11, wherein the at least one differential pressure oil supply flow path includes a first hole formed in a first surface of the orbiting end plate and connected to an oil introduction chamber formed among the rotary shaft, the main frame, and the orbiting scroll, a second hole formed in the first surface of the orbiting end plate and connected to the intermediate pressure chamber, and a first horizontally extending flow path that connects the first hole and the second hole and is formed inside of the orbiting end plate.

14. The compressor of claim 13, wherein the at least one integrated flow path includes a third hole formed in a first surface of the fixed side wall and connected to the intermediate pressure chamber, a fourth hole formed in a first surface of the fixed end plate and connected to the compression chamber, and a second horizontally extending flow path that connects the third hole and the fourth hole and is formed inside of the fixed end plate.

15. A compressor, comprising:

a main frame including a frame end plate, a frame shaft-receiving portion provided at a center of the frame end plate and through which a rotary shaft passes, a frame side wall that protrudes from an outer peripheral portion of the frame end plate, and an intermediate pressure chamber formed inside of the frame side wall;

a fixed scroll including a fixed end plate facing the frame end plate, a fixed wrap that protrudes from the fixed end plate, a fixed side wall that protrudes from an outer peripheral portion of the fixed end plate, and an integrated flow path that connects a first surface of the fixed side wall and a first surface of the fixed end plate inside of the fixed end plate; and an orbiting scroll including an orbiting end plate, an orbiting wrap that protrudes from the orbiting end plate to form a compression chamber with the fixed wrap and perform an orbiting motion with respect to the fixed wrap, and at least one differential pressure oil supply flow path that provides oil discharged through at least one oil hole provided in the rotary shaft to the intermediate pressure chamber, wherein the integrated flow path connects the intermediate pressure chamber and the compression chamber to provide a compressed refrigerant in the compression chamber to the intermediate pressure chamber and provide oil in the intermediate pressure chamber to the compression chamber, wherein the intermediate chamber is formed at an inner surface of the main frame, and wherein a first direction in which the differential pressure oil supply flow path extends outward from the inside of the orbiting scroll is different from a second direction in which the integrated flow path extends outward from the inside of the fixed scroll.

16. The compressor of claim 15, wherein an angle between the first direction and the second direction is an acute angle or an obtuse angle.

17. The compressor of claim 15, wherein the fixed scroll includes only one integrated flow path, and the one integrated flow path connects the intermediate pressure chamber and the compression chamber to form a back pressure that presses the orbiting scroll in a direction of the fixed scroll, and provides oil in the intermediate pressure chamber to the compression chamber.

18. The compressor of claim 15, wherein the rotary shaft includes an oil flow path that extends in an axial direction of the rotary shaft and at least one oil hole that extends in a radial direction of the rotary shaft from the oil flow path, and wherein oil provided through the oil flow path is discharged through the at least one hole into an oil introduction chamber formed among the rotary shaft, the main frame, and the orbiting scroll.

19. The compressor of claim 18, wherein the at least one differential pressure oil supply flow path connects the oil introduction chamber and the intermediate pressure chamber, and provides the oil discharged into the oil introduction chamber to the intermediate pressure chamber.

* * * * *